United States Patent [19]

DiChiara

[11] 4,349,055

[45] Sep. 14, 1982

[54] FILLING VALVE FOR BEVERAGE CONTAINER FILLING MACHINE

[76] Inventor: Anthony J. DiChiara, 10 St. Paul's Crescent, Garden City, N.Y. 11530

[21] Appl. No.: 224,744

[22] Filed: Jan. 13, 1981

Related U.S. Application Data

[63] Continuation-in-part of Ser. No. 972,282, Dec. 22, 1978, abandoned.

[51] Int. Cl.[3] ..... B65B 31/00

[52] U.S. Cl. ..... 141/39; 141/46; 141/302

[58] Field of Search ..... 141/6, 39, 40, 46, 197, 141/286, 302, 392

[56] References Cited

U.S. PATENT DOCUMENTS 2,063,326 12/1936 Meyer ..... 141/39

4,089,353 5/1978 Antonelli ..... 141/302

*Primary Examiner*—Frederick R. Schmidt

*Attorney, Agent, or Firm*—Ostrolenk, Faber, Gerb & Soffen

[57] ABSTRACT

A filling valve for filling a container from a pressurized liquid filled bowl is disclosed. The filling valve includes a housing with a liquid filling orifice through it and a liquid flow valve for opening and closing that orifice. A gas flow tube extends through the liquid flow valve element and projects both above and below it. A pressure responsive piston is supported on the gas flow tube. A cover is located over the gas flow opening at the top of the gas flow tube and includes a closure element ball. A sleeve supports the closure element above the top opening of the tube. A spring holds the closure element off the top opening of the tube. A guide sleeve outside the supporting sleeve is connected with the gas flow tube. A spring biases the supporting sleeve out of the guide sleeve. A cam has one orientation at which it closes both the gas flow tube and the liquid flow valve element and a second orientation at which the cam permits both of the supporting sleeve and the guide sleeve to rise under the influence of the respective springs acting on them, for selectively opening the gas flow tube and the liquid flow valve. A sudden pressure differential along the gas flow tube, due to a container breaking, draws the closure element to close the top opening at the tube.

58 Claims, 28 Drawing Figures

FIG. 1.
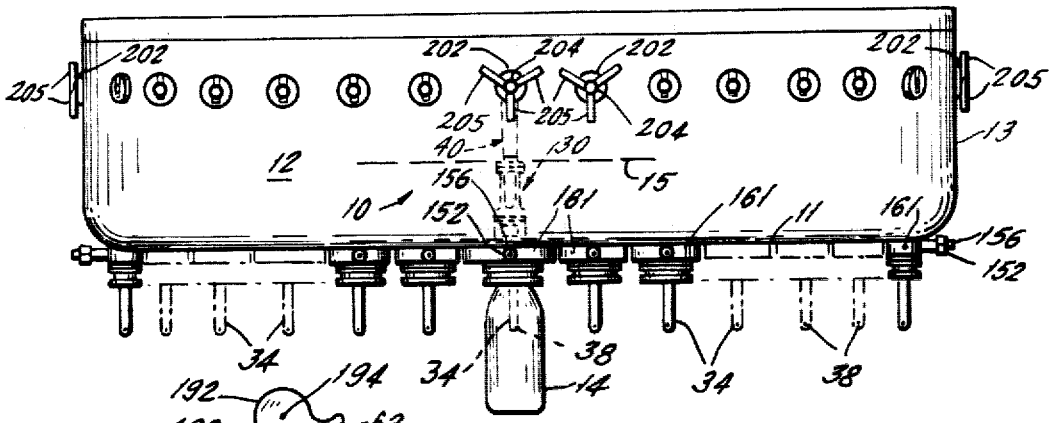
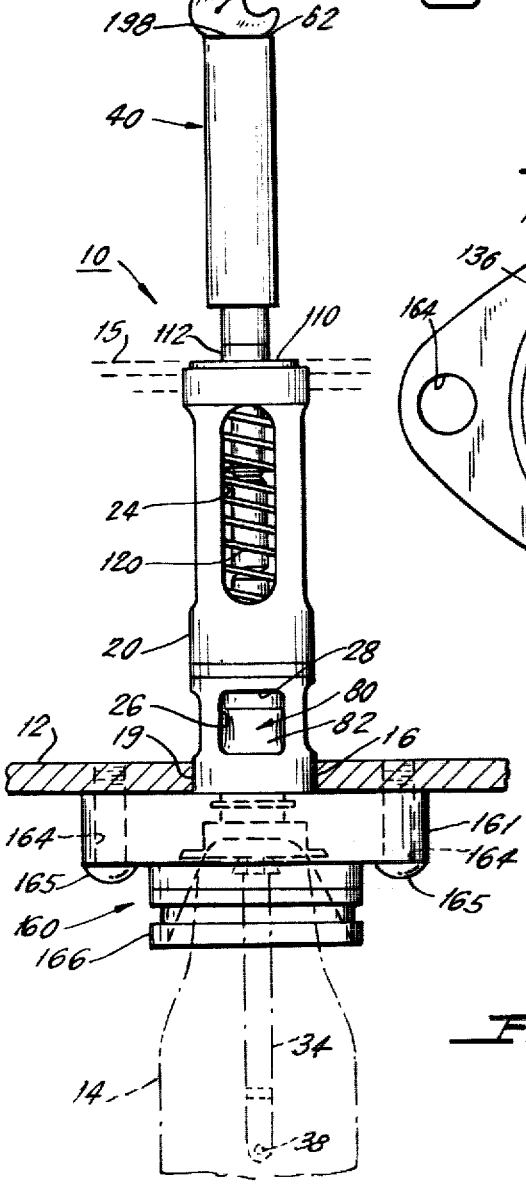
FIG. 7.
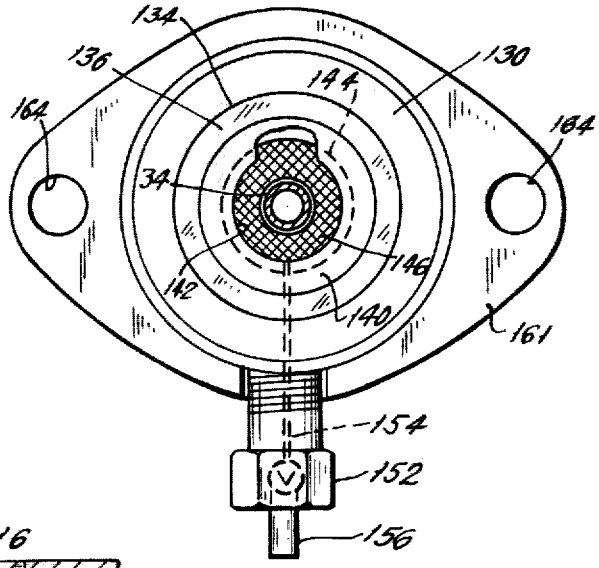
FIG. 6.

FIG. 10.
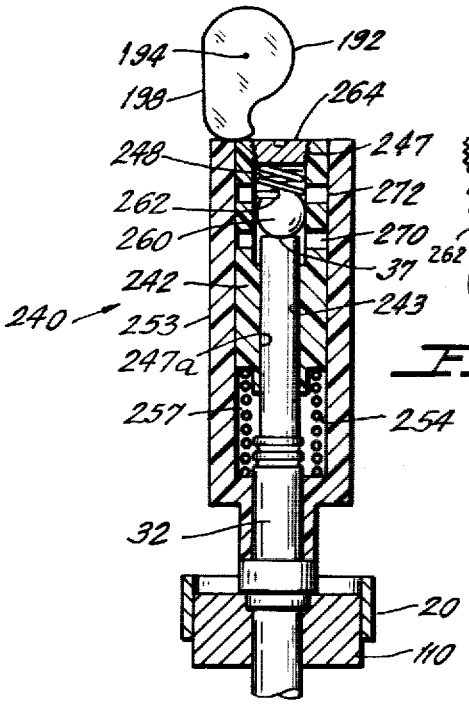
FIG. 13.
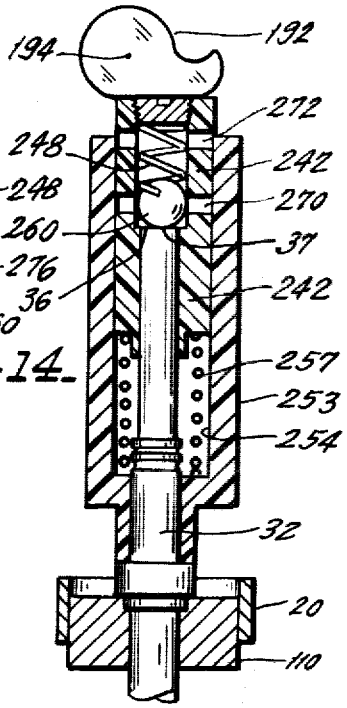
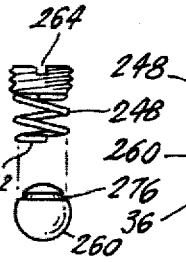
FIG. 14.
FIG. 11.
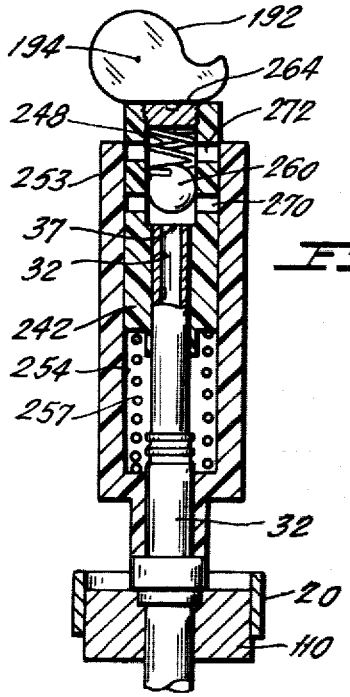
FIG. 12.
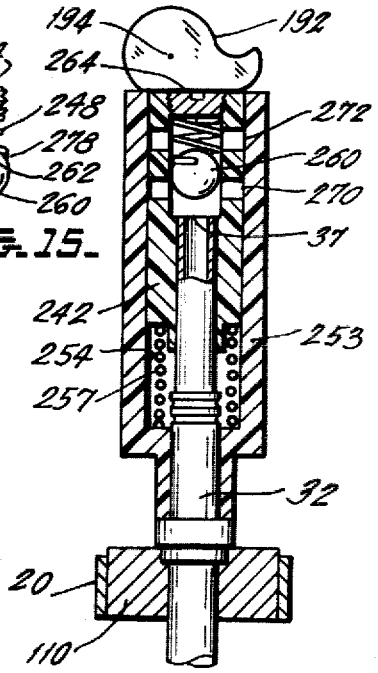
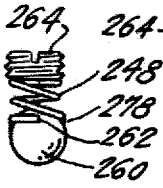
FIG. 15.

FILLING VALVE FOR BEVERAGE CONTAINER FILLING MACHINE

CROSS-REFERENCE TO RELATED APPLICATIONS

This is a continuation-in-part of application Ser. No. 972,282, filed Dec. 22, 1978, now abandoned.

The present invention relates to a filling valve useful in a beverage container filling machine of the type which fills beverage containers from a large bowl of liquid which is held under elevated pressure. In particular, the invention is directed to such a filling valve, which seals itself closed against further liquid flow, but more important, against further gas flow upon a drop in pressure occurring at the container being filled, as might occur if a container breaks or becomes absent during filling.

BACKGROUND OF THE INVENTION

Beverage containers, particularly rigid walled ones, such as juice containers, soda bottles, wine bottles, or the like, are often filled from a pressurized, liquid containing bowl of a filling machine. Although the invention is hereafter described in connection with beverage containers, it is not thus limited and is applicable to any liquid in any type of container, so long as the container is filled under pressure from a pressurized source, like a bowl. The pressurized bowl has a plurality of filling valves communicating into it. Each filling valve is alternately connected to and disconnected from an individual container. The bowl is pressurized in order to speed the filling of the individual beverage containers, without significant interference to the flow due to the viscosity of the liquid, the narrow width of the filling orifice or other well-known impediments to rapid filling of a container.

The entrance to each filling valve is located inside the pressurized bowl and its exit is outside the pressurized bowl. Conventional filling valves are, therefore, designed to prevent leakage of pressurized liquid from the filling bowl when a bottle or container is not present. The filling valves also include means that prevents exit of pressurizing gas from the filling valve when a container is not present.

For control of liquid undesirably leaking through the filling valve, conventional filling valves include an axially shiftable piston having a valve element thereon. The valve element is raised off a valve seat to open the liquid feeding orifice leading to the container being filled, but the liquid flow blocking valve element is normally urged against the valve seat to close the feeding orifice when a container to be filled is not present.

Conventional filling valves are cam operated between their liquid flow blocking and permitting positions. Control means external to the bowl operate the cam between the filling valve positions in appropriate sequence coordinated with the presence or absence of the container to be filled.

Conventional filling valves also include a separate gas flow passage communicating between the gas under pressure inside the bowl through the filling valve and extending down so as to be insertable in the container to be filled. In a typical beverage filling valve of the type to which the present invention applies, the gas filling conduit is a tube and the liquid flows into the container outside the tube. An appropriate cover or capping means over the top of the tube is selectively opened or closed in timed sequence to permit gas to escape through the tube into a container or to prohibit such escape. The same cam that controls the positions of the liquid flow valve element also caps or uncaps the gas flow tube. So long as a container is properly placed at a filling valve during each filling cycle, the cam controlled means opens both the liquid flow valve and the gas flow tube in timed sequence and causes them to be reclosed in proper timed sequence.

When a container to be filled is present, and both the gas flow conduit and the liquid flow valve are open, and if the container is removed, for example by breaking, in the conventional filling valve, different things occur with the liquid and the gas flows.

With the container suddenly absent, a great liquid pressure differential develops between the interior of the pressurized bowl in which the liquid flow valve element of the filling valve is located and the exterior of the pressurized bowl in the immediate vicinity of the liquid flow valve element. This pressure differential urges liquid to flow rapidly out of the filling valve and the force of the liquid trying to flow out the valve and past the flow valve element, coupled with the great pressure differential on the flow valve element itself, immediately urges the flow valve element to its closed position, cutting off liquid flow.

However, the gas will continue to exit through the gas flow conduit of the valve until such time in the cycle as the cover on the gas flow is reclosed to its flow blocking position by the closing cam.

Various arrangements have been attempted for sensing the pressure drop at the outlet end of the gas flow conduit when a container is suddenly absent and for causing this sensed pressure drop to activate the cover to close the inlet to the gas flow conduit. However, such means have not operated effectively, and there is continuous gas escape from the pressurized bowl through the gas flow conduit until the closing cam in due time during the cycle mechanically recloses the cover over the opening into the gas flow conduit. Effective means are thus required for closing the gas flow conduit if, suddenly, no container is present to receive liquid through the filling valve.

SUMMARY OF THE INVENTION

Accordingly, it is the primary object of the present invention to provide an improved filling valve for a beverage container filling machine of the multiple outlet valve variety.

It is another object of the present invention to provide such a filling valve which helps rapidly dispense liquid to a container to be filled.

It is a further object of the invention to halt the flow of pressurized gas through the gas flow conduit of a filling valve when a container is absent.

It is yet another object of the invention to prevent flow of pressurized gas through the gas flow conduit of a filling valve if a container becomes absent during filling, for example, through breakage.

The filling valve according to the invention comprises a feeding orifice that communicates through the wall of the pressurized bowl and that is placed in the bowl such that when the bowl has liquid to be dispensed in it, the liquid passes through the feeding orifice to exit from the bowl. A liquid flow valve element is positioned at the orifice and is shiftable axially of the filling valve between a position on a valve seat of the valve where the valve element blocks the feeding orifice to a position off the valve seat which permits liquid to flow past the liquid flow valve element. The liquid flow valve element is normally biased off the valve seat.

The filling valve further comprises a gas flow conduit which has one entrance opening that extends into the gas pocket toward the top of the pressurized bowl above the top of the pool of liquid therein. This conduit extends down through the liquid flow valve element in a liquid tight seal and the gas flow conduit includes an extension that extends down beneath the liquid flow valve element and into the container to be filled. It is intended that when the filling valve is placed on a container with the gas flow conduit extension inserted into the neck of the container, and after the neck of the container has been emplaced against a filling bell for the filling valve, then the gas flow conduit will be opened, by means described below, to permit gas pressure to build up in the container to be filled until the gas pressure in the container is at the same level as the gas pressure in the bowl.

A cam, which is controlled externally of the pressurized bowl, is operated to selectively open or close a cover or capping means on the gas flow conduit, with the conduit intended to be closed or capped when no container is present and with the conduit intended to be open when it is intended that a container be present. When the cam permits the cover for the gas flow conduit to open, this permits the gas in the filling bowl to escape through the conduit into the container being filled thereby bringing the container pressure to the pressure in the bowl.

The cam is also arranged to press the gas flow conduit toward the liquid feeding orifice from the bowl. The gas flow conduit is a tube that is mechanically so connected to the liquid flow valve element that when the gas flow conduit is pressed by the cam toward the feeding orifice from the bowl, the liquid flow valve element is pressed against its seat and the liquid feeding orifice is sealed.

The top side of the gas flow conduit tube and the top side of a piston connected with that tube and with the liquid flow valve element face upwardly into the filling bowl. The other, bottom side of the liquid flow valve element faces through the feeding orifice of the filling bowl to the exterior. The bottom of the liquid flow valve element is exposed to the pressure outside the bowl and thereby also to the pressure in the container being filled when that container is in place. Since the pressure inside the pressurized bowl is initially greater than that outside the filling bowl, the liquid flow valve element is held securely against its valve seat, and flow of liquid out of the bowl is precluded. When the gas pressure in the container to be filled is equalized with the gas pressure in the bowl through the gas flow conduit, then a spring biasing means normally biases the liquid flow valve element off its valve seat, which permits liquid to flow under the elevated gas pressure in the bowl past the liquid flow valve element and into the container, until the container has been filled.

When the container has been filled, the cam is operated to another operational condition to cause the cover to close the entrance at the top of gas flow conduit tube. This again causes the cover to stop gas flow out of the bowl and also presses the liquid flow valve element against its valve seat, thereby halting further liquid flow from the bowl.

It is when a container becomes absent during container filling that the invention provides its significant benefit. First throttling of liquid flow will be discussed. When a container is removed while the gas flow conduit is open and while the liquid flow valve is open, e.g., through container breakage, suddenly, a great pressure differential develops between the interior of the pressurized bowl and the outside of the bowl at the filling orifice where the container is missing. There is a piston connected with the gas flow conduit tube which piston is of relatively larger diameter. The suddenly relatively elevated pressure against the top of that piston and the suddenly elevated liquid pressure against the top of the liquid flow valve element drives the piston and the liquid flow valve element toward the filling orifice. This moves the liquid flow valve element toward and into engagement with its valve seat, thereby reclosing the open liquid feeding orifice and immediately halting the undesired dispensing of liquid during that container filling cycle. Eventually, after a predetermined time interval, the cam operates again and recloses the gas flow conduit tube and also securely mechanically presses down on the gas flow conduit tube and on the liquid flow valve element connected to the gas flow conduit, and the valve element is pressed against its valve seat. The affected filling valve is thus automatically again prepared for the next filling operation.

It is in connection with stopping escape of gas that the invention provides its most important benefit. The cover or capping means is designed to reliably close the upper entrance to the gas flow conduit tube as soon as a large pressure drop occurs at the bottom exit from that tube, as when a container suddenly becomes absent. Most broadly described, the cover comprises a closure element support sleeve over the gas flow conduit tube. A closure element for the upper entrance to the tube is carried by and inside the support sleeve. The support sleeve is normally spring biased to move the closure element off the entrance to the gas flow conduit. The separate closure element in the sleeve is normally biased by separate biasing means away from the entrance to the gas flow conduit. When the cam moves to one position, it urges the support sleeve of the cover, against the bias of a spring, toward the feeding orifice from the feeding bowl. In so doing, the cam drives the closure element against the entrance opening to the gas flow conduit tube to assure that the gas flow conduit tube is sealed closed. When the cam moves to a second position, it does not press down upon the support sleeve, whereby the biasing means for that sleeve urges the sleeve up and also permits the closure element in the sleeve to rise off the entrance to the gas flow conduit tube.

The cover or capping means is so designed that when a sudden pressure differential develops between the gas pocket in the pressurized bowl and the outlet from the gas flow conduit tube where the container should normally have been, then the pressure differential acts upon the closure element in its support sleeve, overcomes the force of the closure element biasing means and drives the closure element against the entrance to the gas flow conduit tube, for closing off the gas flow conduit tube during that operating cycle. During this action, the support sleeve need not shift. Eventually, in due time during the cycle, the cam operates to its first position, which moves the support sleeve of the cover back toward the liquid filling orifice from the bowl. This again mechanically urges the closure element against the entrance to the gas flow conduit tube to seal the same, as occurs at the end of a normal cycle. Although the preceding description referred to the support for the closure element as being a sleeve around the entrance to the gas flow conduit tube, it should be understood that any other configuration of a closure element support that performs the functions as described above could be used.

Various embodiments of the cover or capping means are contemplated within the invention, but all have the characteristics noted above. Biasing means for normally biasing the closure element support so as to raise the closure element off the entrance to the gas flow conduit tube comprises a spring interposed between the support or support sleeve, on the one hand, and the gas flow conduit tube, on the other hand, whereby the spring and sleeve move together with the gas flow conduit tube and the biasing means for the sleeve or support is operative only as that sleeve or support moves with respect to the gas flow conduit tube.

The separate biasing means for the closure element is supported in the support or support sleeve of the cover or capping means. In one preferred embodiment, a resilient O-ring is interposed inside the sleeve and above the entrance to the gas flow conduit tube when the sleeve or support has been permitted to rise under the influence of its own biasing means. The closure element may here comprise a ball that is held up by the O-ring. Upon the large pressure differential developing, as described above, the ball is forced past the O-ring and is driven against and held by the pressure against the entrance to the gas flow conduit tube to seal the same. An alternate form of biasing means for the closure element comprises a spring supported in the sleeve or support and carrying the closure element thereon. The spring normally urges the closure element off the entrance to the gas flow conduit tube. A sudden pressure differential rising for the reasons discussed above will suddenly drive the closure element against the entrance to the gas flow conduit tube to close the same.

Other objects and features of the present invention will become apparent from the following detailed description of preferred embodiments of the invention taken in conjunction with accompanying drawings.

BRIEF DESCRIPTION OF THE DRAWINGS

FIG. 1 is a side view of a filling bowl containing a plurality of filling valves according to the invention;

FIG. 6 is an elevational view of the filling valve of FIGS. 2–4 showing the valve in the condition of FIG. 4;

FIG. 7 is a cross-sectional view along the line 7—7 in FIG. 4;

FIG. 10 is a fragmentary view of a filling valve according to a second embodiment of the invention and in the same condition as in FIG. 2;

FIG. 11 is the same type of view as FIG. 10 showing the filling valve in the condition illustrated in FIG. 3;

FIG. 12 is the same type of view as FIG. 10 showing the filling valve of this embodiment in the condition illustrated in FIG. 4;

FIG. 13 is the same type of view as FIG. 10 showing the filling valve of this embodiment in the condition illustrated in FIG. 5;

FIG. 14 is a partial view of the closure element shown in the filling valve in FIG. 10 and showing one manner of securing the closure element;

FIG. 15 is the same type of view as FIG. 14 showing another manner of securing the closure element;

DESCRIPTION OF PREFERRED EMBODIMENTS

Figures 2, 8, 9:
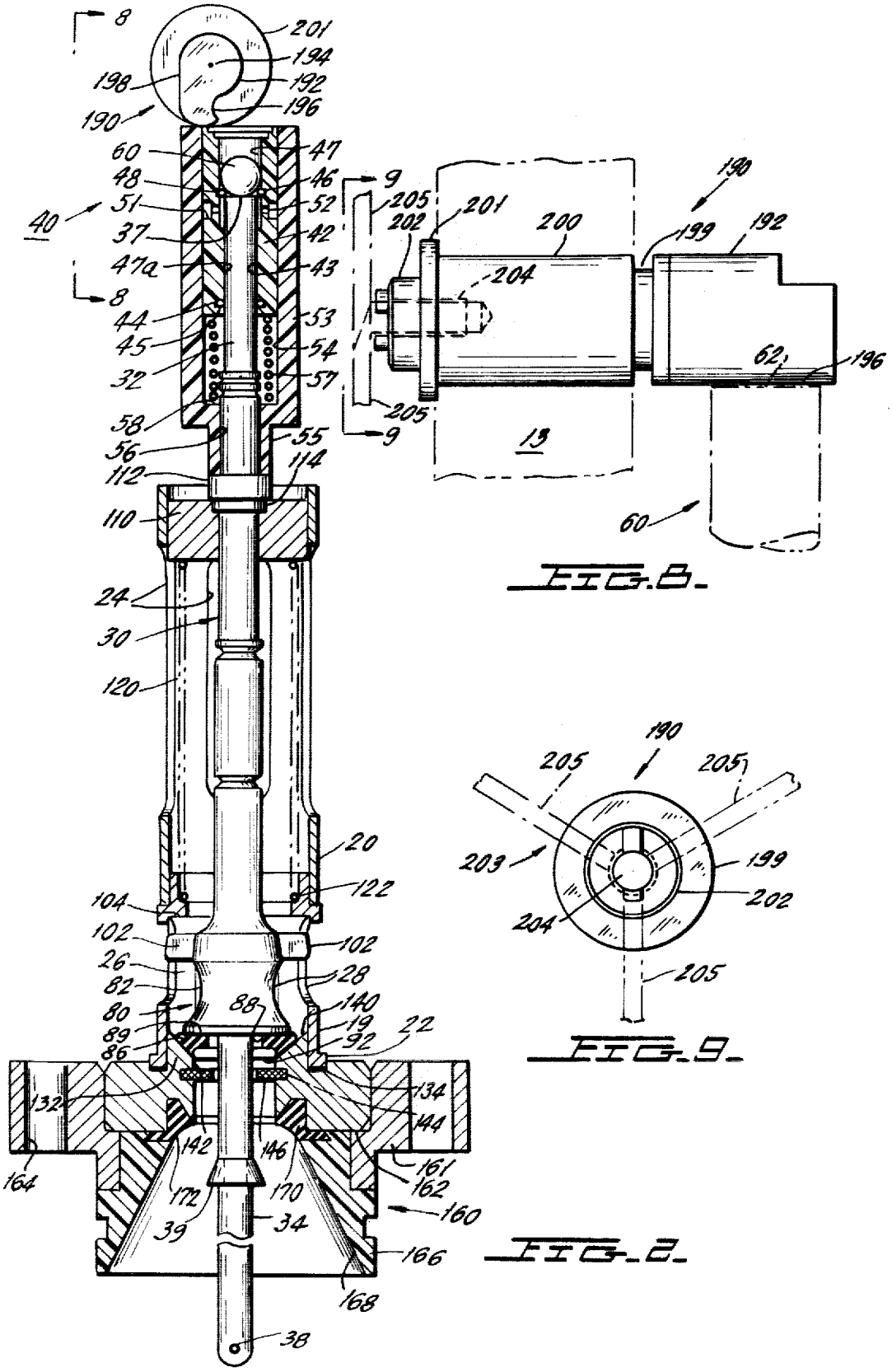
FIG. 2 is an elevational view in cross section of an embodiment of the filling valve according to the present invention in the fully closed condition.
FIG. 8 is a fragmentary view of the upper section of the filling valve of FIG. 2, showing the cam arrangement for the filling valve.
FIG. 9 is a view in the direction of arrows 9 in FIG. 8 showing a cam operator for use in conjunction with the cam arrangement shown in FIG. 8.
Figure 4:
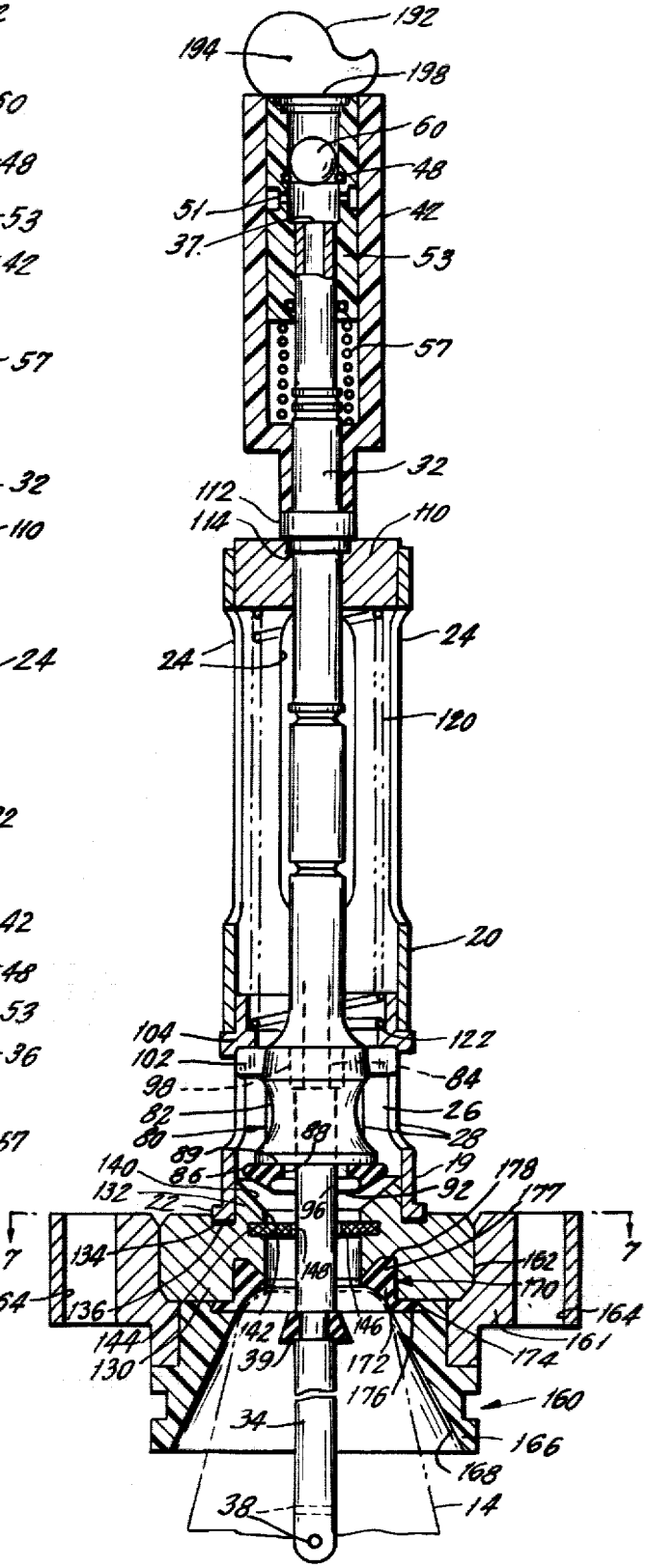
FIG. 4 is the same type of view as FIG. 2, but showing the filling valve in the fully open condition with liquid being dispensed to the container.

Referring to FIG. 1, a filling valve 10 according to a first embodiment of the present invention is intended for use in conjunction with a quite large filling bowl 12 that is conventionally held under elevated pressure, as is well known in the art. The level 15 of liquid in the filling bowl 12 is maintained substantially at the height illustrated, above the below-described housing 20 of the filling valve. A conventional floating ball type valve maintains that level throughout the filling operations. The bottom 11 of the filling bowl 12 has a plurality of openings 16 defined through it (see FIG. 5), each for receiving a respective filling valve. The filling bowl has a plurality of filling valves 10 arrayed around it. Referring to FIGS. 2, 4 and 6, the thickness of the bowl 12 at its bottom approximates the height of the lower section 19 of the below described filling valve housing 20 between its flange 22 and the lower end of its housing ports 28. The bowl 12 has a side wall 13 that extends up past the top end of the below described cover or capping means 40 of each filling valve 10.

Each filling valve is brought into communication with a container 14 to be filled. The container is filled with liquid and it then is removed from the valve.

One of the filling valves 10 of the first embodiment is now discussed.

Each opening 16 in the bottom 11 of the filling bowl 12 sealingly receives the periphery of the filling valve housing 20. The flange 22 at the base of the housing 20 is pressed against the underside of the bowl 12, thereby positioning the housing and sealing the opening 16 through the bowl.

The housing 20 is a cylindrical tube. It has a plurality of upper section cutouts 24 defined therein. These cutouts prevent liquid and/or gas pressure from building up inside the housing 20 which could prevent the shifting of the below-described piston 110 and the liquid flow valve element 82.

The lower section of the housing 20, in which the below described liquid flow valve element 82 is positioned, is defined by a plurality of narrow-width struts 26, which separate adjacent quite large ports 28 that communicate between the liquid in the bowl 12 and the interior of the housing 20. The narrowness of the struts 26 assures maximum liquid flow over the valve element 82.

There is a gas flow conduit 30 that is comprised of an upper gas flow tube 32, which passes into and partially through the below-described liquid flow valve element 82 and a lower gas flow tube 34 that extends from inside the valve element 82 to beneath the valve element 82. The upper end 36 of the upper tube 32 has an opening 37 into it which is one terminal of the conduit 30. The upper end 36 of the tube 32 extends above the level of the liquid in the bowl 12 so that gas under pressure in the bowl 12 can communicate with the container 14 through the conduit 30. The gas flow conduit 30 extends down from its upper end and terminates at the openings 38 at the bottom of the lower tube 34. The lower tube 34 is positioned inside each container 14 as it is being filled and the openings 38 are stationed near the top of the container.

When the gas flow conduit 30 is open and the lower tube 34 is in the container 14, the open passage between openings 37 and 38 establishes uniform gas pressure between the bowl 12 and the container 14. As the container 14 is thereafter filled with liquid from the bowl 12, the pressurized gas in the container 14 is displaced from the container by the inflowing liquid, enters conduit 30 through openings 38 and exits from the conduit 30 through the opening 37 inside the bowl 12, maintaining constant pressure between the bowl 12 and the container 14. Ultimately, when the level of liquid in the container 14 rises to cover the openings 38, no more gas can be displaced from the container 14, and because the pressure between the container 14 and the bowl 12 is equalized, no more liquid can be fed into the container 14 from the bowl. Thus, the depth of the openings 38 in the container 14 establishes the height which the liquid can attain in the container 14.

The lower tube 34 carries a small conical deflector 39 on it which is below the main filling orifice 142, described below, for deflecting liquid that is pouring down the outside of the tube 34 so that the liquid falls free of the tube 34 and away from the gas openings 38, whereby the inflowing liquid will not interfere with the gas flow through the openings 38.

A cover or capping means 40 are provided for selectively capping and closing or uncapping and opening the opening 37 at the top end 36 of the upper tube 32 of the gas flow conduit 30. The first embodiment of the cover 40 in FIG. 2 comprises a hollow closure element support sleeve 42, which slidingly fits around the exterior of the upper portion 43 of the upper tube 32. The upper bore portion 47 of the sleeve 42 is slightly wider than the lower bore portion 47*a* thereof for enabling the lower bore portion of the sleeve to be guided on the tube 32. The bore 47 of the sleeve 42 is internally grooved at 44 to receive an O-ring 45 therein, which provides a sealing engagement with the tube upper portion 43 while still permitting the sleeve 42 to shift axially with respect to the upper tube 32. A second groove 46 is defined further up the bore 47 of the sleeve 42. The annular groove 46 carries in it an O-ring 48 which serves as a biasing means for the below described closure element 60. O-ring 48 seeks to hold the below described closure element 60 in the upraised condition of FIG. 2.

The exterior of the sleeve 42 is grooved at 51 to define a pathway for glas flow. Communicating between groove 51 and bore 47 are a plurality of openings 52 which communicate into bore 47 below closure element 60 when it is upraised. The openings 52 provide access for gas to flow between the bowl 12 and the opening 37 of the tube 32, which helps to drive the closure element 60 down, as described below.

The top of the bore 47 is open and the below described closure element 60 could easily fall out of that open end. However, gravity and gas pressure hold the closure element 60 in place inside the bore 47 and the cam 192, described below, prevents the closure element from moving out of the bore 47 at a time of turbulence in the filler valve for example, as when liquid flow commences or terminates or when a sudden absence of the container occurs.

An exterior hollow guide sleeve 53 is positioned outside the sleeve 42. It has a bore 54 through which the support sleeve 42 is slidable. The guide sleeve 53 has a lower section 55 with a smaller diameter bore 56 for slidingly engaging and being guided for longitudinal movement with respect to the upper tube 32 that passes through the bore 56. The bore 56 and the tube 32 guide and orient the guide sleeve 53. A compression spring biasing means 57 is located inside the exterior guide sleeve 53 and one end thereof rests on the shelf 58 at the bottom of the wider bore of the sleeve 53 while the other end of the spring 57 normally presses against the underside of the support sleeve 42. As a result, the sleeve 42 is always biased up with respect to the sleeve 53 and away from the liquid feeding orifice 142, described below.

The lower section 55 of the sleeve 53 always rests upon the top of the collar 112 which is integrated with the below described piston 110. Thus the sleeve 53 moves together with the piston 110. The piston 110 also moves together with the conduit 30.

There is a closure element 60 for closing the opening 37 at the upper end 36 of the tube 32. The closure element closes the opening 37 before a container 14 is positioned for being filled (FIG. 2) and also closes that same opening 37 in the event the container 14 suddenly becomes absent, due to breakage for example.

The closure element 60 comprises a ball which is adapted to sealingly seat on the O-ring biasing means 48 and, even more important, to sealingly seat on the open end 36 of the tube 32 for sealing the opening 37 closed. The closure element 60 is dimensioned slightly smaller in diameter than the cross-section of the upper section of the bore 47 through the sleeve 42, whereby gas can now move past the closure element 60 from inside the bowl 12 and move down through the tube 32. Operation of the cover 40 is described below.

The important feature of the cover 40 is the presence of two separate biasing means, one biasing means 48 for biasing the closure element 60 to remain in one position with respect to the sleeve 42 and to prevent the closure element 60 from moving down toward the opening 37 when the sleeve 42 moves up with respect to the tube 32 as the filling valve operates as described below. There is a separate second biasing means 57 that communicates on the one hand between the supporting sleeve 42 for the closure element 60 and, on the other hand, through the sleeve 53, 55, the collar 112 and the piston 110, with the conduit 30, whereby the support sleeve 42 is normally biased upwardly with respect to the gas flow conduit 30 and the below described flow valve element 82.

There are alternate embodiments of the cover or capping means that are described with reference to FIGS. 10–13 and 16–19. Those alternate embodiments all rely on the same principal of two cooperating but independent biasing means, one between the support for the closure element and the closure element and the other between the gas flow conduit and the support for the closure element. These alternate embodiments will be described below following the description of the operation of the first embodiment of the filling valve.

The upper gas flow tube 32 extends down to and is integrally formed with the generally bell-shaped liquid flow valve element 82 of the liquid flow control valve 80. The tube 32 extends into a continuing passageway 84 through the valve element 82. The exterior of the valve element 82 might be generally frusto-conical in shape. However, in order to maximize liquid flow through the housing 20, over the valve element and into the container 14, the bell shape for element 82 is preferred. The bottom of the valve element 82 is wider than the top.

The lower end of the valve element 82 carries an annular, generally frusto-conically shaped, resilient, valve element sealing element 86 that tapers narrower downwardly and that is captured in a groove 88 that is defined between the collar 89 above the groove 88 and the integral underside cap 92 at the bottom of the valve element 82. The resilient sealing element 86 cooperates with the below described valve seat 140 on the below described snift block 130.

The valve element 82 has an entrance opening 96 defined centrally thereof and extending in through the underside cap 92 thereof into the interior of valve element 82 where the opening 96 communicates with the passageway 84 through the valve element 82 to define a continuous flow passageway through the valve element 82 and into the lower gas flow tube 34. The gas flow tube 34 has a snap-in sealing connection 98 inside the valve element 82, by which the tube 34 is secured in place and from which it can be snap removed for replacement, servicing, etc.

The valve element 82 also carries abutment elements 102 at its upper end which project from the side of the valve element 82 for abutting the cooperating annular abutment ring 104 supported in the housing 20 at the top ends of the openings 28. The engagement between the abutment elements 102 and the ring 104 determines the upper limit of motion of the valve element 82.

An axially shiftable piston 110 is positioned inside the upper end of the housing 20. There is a collar 112 around the tube 32 located at the upper end of the housing 20. The piston 110 has an opening 114 at its top and in which the sleeve 112 can easily nest. The collar 112 prevents the piston 110 from moving up beyond the collar. As a result, the below described spring 120 raises both of the gas flow conduit 30 and the flow valve element 82 together. The collar 112 permits the piston 110 to move down into the housing 20 away from the collar 112.

There is a compression spring 120 inside the housing 20 which extends between the underside of the piston 110 and a shelf 122 on the top side of the above described abutment ring 104. The spring 120 normally drives the piston 110 into continuous engagement with the collar 112. Through the connection of the collar 112 with the tube 32, the spring 120 thereby normally biases the flow valve element 82 upwardly to the position illustrated in FIG. 4, where the abutments 102, 104 abut.

Referring to FIGS. 2, 4 and 7, the filling valve 10 is supported on the snift block 130. The snift block includes the annular collar 132 whose outer periphery engages against the interior of the housing 20 which prevents leakage past the exterior of collar 132. An annular groove 134 is defined on the top surface of the snift block 130 and it is shaped and profiled to receive the above described flow valve housing flange 22. An annular flat gasket 136 is seated in the groove 134 and the flange 22 is pressed down against the gasket 136 and into the groove 134 to seal the snift block to the housing 20 to prevent leakage of liquid therepast.

The sleeve 132 defines a frusto-conically shaped internal surface 140, which defines a valve seat that is angled to mate with the tapering lower surface of the sealing gasket 86 and of the lower disc 92 on the flow valve element 82. The seat 140 surrounds and defines a large cross-section filling orifice 142 through which liquid that has passed by the seat 140 enters the below described filling bell 160. When the flow valve element 82 is lowered to the seat 140, passage of liquid through the housing wall openings 28 and past the flow valve element 82 into the filling bell 160 is prevented. When the flow valve element 82 is upraised off the seat 140, liquid may flow from the interior of the bowl 12 through the openings 28 in the lower section of the housing 20, past the flow valve element 82, over and past the seat 140 and into the filling orifice 142.

The interior wall of the filling orifice 142 is grooved annularly at 144 to receive the annular screen filter 146 that extends into the groove 144 for being supported there. The screen filter 146 has an inner diameter 148 that substantially corresponds to the outer diameter of the lower gas flow tube 34, minimizing the passage of unfiltered liquid into the container 14.

The snift block 130 has a gas exhaust valve 152 associated with it, including a valve passage 154 communicating into the liquid filling orifice 142 and a valve operator 156. Upon operation of the valve operator, the valve 152 opens and air and gas are exhausted from the orifice 142 within the snift block. It is intended that the exhaust valve 152 be operated after a container 14 has been filled and after the flow valve element 82 has reclosed against the valve seat 140 for preventing further entrance of liquid into the container 14. As noted above, the container 14 has been pressurized above atmospheric pressure and removal of the container out of the below described filling bell 160 while the container 14 is at elevated pressure would cause an extremely rapid pressure drop in the container producing a 'pop' and turbulence in the liquid and might damage the container 14. The exhaust valve 152 is operated to allow relatively slower escape of gas from the top of the container to atmosphere before the container 14 is removed.

Referring to FIGS. 2, 4, 6 and 7, the snift block 130 is supported in the container filling bell 160. The filling bell 160 includes the main fastening section 161 which is comprised of metal. The main fastening section 161 includes an annular socket groove 162 in its top side for receiving the snift block 130 and the snift block 130 is peripherally profiled to nestingly securely fit in the socket groove 162. The fastening section 161 includes a plurality of fastening element receiving openings 164 extending axially therethrough. Appropriate fastening means 165 pass through the openings 164 and into appropriate receptacles under or in the bowl 12 for fastening the filling bell 160 to the bowl 12. Such fastening of the filling bell positions the entire filling valve 10 due to the interconnection of is various elements.

The filling bell fastening section 161 supports the preferably rigid, plastic material filling bell element 166. The bell element 166 is a depending sleeve with a generally frustoconically shaped opening 168 defined beneath it. The tapered shape of the opening 168 guides the neck of a container 14 toward a seat 172 therefor in the filling bell.

At the top side of the filling bell element 166 is the resilient annular gasket 170 which has a generally rounded underside seat portion 172 against which the neck of a container 14 is securely pressed for making a liquid tight seal. The bell element 166 is grooved at 174 for receiving the gasket flange 176 which holds the gasket 170 securely in place on the bell element 166. The top side of the gasket 170 defines an annular sleeve 177 and the underside of the snift block 130 is grooved at 178 in a shape generally conforming of the exterior profile of the gasket sleeve 177 for sealingly receiving the gasket 170.

Referring to FIGS. 1, 8 and 9, on the periphery of the side wall 13 of the bowl 12 is positioned respective cam means 190 for each filling valve 10, which operate upon the tops of both of the above described sleeves 42 and 53 for shifting the sleeves down and for permitting the sleeves to rise under the influence of the respective biasing means 57 and 120 therefor. The cam thus selectively closes and permits opening of the entrance opening 37 at the top 36 of the gas flow conduit 30 and at the same time selectively closes and permits opening of the flow valve element 82, because the valve element 82 is integrally connected with the tube 32 and shifts with that tube.

The cam means 190 comprises the cam 192 which, as shown in FIG. 2, is irregularly shaped. The cam 192 rotates around an axis at 194. Cam 192 has a larger diameter section 196 which merges into a smaller diameter section 198. When the cam 192 is in the orientation illustrated in FIG. 2, its larger diameter section 196 is pressing down upon both of the sleeves 42 and 53 for closing both of the liquid flow orifice 142 and the gas flow conduit 30 of the filling valve 10. When the cam 192 has been rotated to the orientation illustrated in FIGS. 3–5, the smaller diameter section 198 thereof permits both of the sleeves 42 and 53 to rise, which, as described below, enables both gas and liquid to communicate into the container 14.

The cam 192 is carried on and is an extension of a cam shaft support 199 and this passes through a sleeve 200 that, in turn, nonrotatively passes through the side wall 13 of the bowl 12. The collar 201 on the exterior surface of the bowl side wall 13 positions the sleeve 200 and thereby positions the cam 192.

A cam operator receiving unit 202 is connected with the cam shaft support, such that rotation of the operator 202 rotates the cam 192. As seen in FIG. 9, there is a camming device 203 including a shaft 204 from which three angularly separated arms 205 radiate. The shaft 204 is secured in the cam operator 202. Engagement of the arms 205 with an appropriate abutment (not shown) placed next to the bowl 12 and which abutment relatively moves with respect to the bowl 12, in a manner well known in this art, rotates the arms 205 for rotating the operator 202. The cam 192 is thereby rotated between its two illustrated orientations in appropriate timed sequence.

Operation of the first embodiment of the filling valve 10 according to the invention is now described. The filling valve starts in the inoperative condition illustrated in FIG. 2. In this position, the cam 192 has been rotated so that its longer diameter section 196 is pressing down upon both of the sleeves 42 and 53. The pressure upon external sleeve 53 presses the collar 112, piston 110 and valve element 82 down to close the liquid filling orifice 142. The downward pressure on sleeve 42 presses that sleeve down and compresses the spring 57. The closure element 60 is seated over the opening 37 and seals that opening shut.

When it is time to start filling a container, as shown in FIGS. 4 and 6, a container 14 is placed in the opening 168 of the filling bell sleeve 166 and is pressed against the gasket 172.

Figure 3:
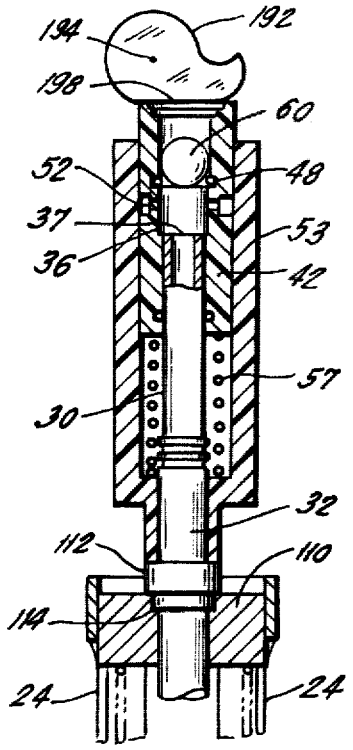
FIG. 3 is a fragmentary view of the filling valve shown in FIG. 2 at the stage of operation where the initial gas flow communication with the container to be filled has been established but liquid is not yet flowing.

The arms 205 are now engaged to rotate the operator 202 which rotates the cam 192 to the orientation illustrated in FIG. 3, wherein in the narrower diameter section 198 thereof faces downwardly toward the filling valve 10. The compressed spring 57 has sufficient spring force to relax and stretch out and this drives the support sleeve 42 upwardly with respect to the guide sleeve 53 so that the top of the sleeve 42 rises above the top of the sleeve 53. The O-ring biasing element 48 raises the closure element ball 60 off the opening 37 in the tube 32 and opens the opening 38 to gas flow. Gas from inside bowl 12 flows into bore 47, past ball 60, through tube 32, 34 and out the openings 38 thereof into the container 14, thereby to raise the pressure in the container to the level of pressure in the bowl. During this gas pressurization process, there is still a pressure differential between the pressure of the liquid inside the bowl 12 and the gas pressure in the container. This pressure differential is sufficient to hold the filling valve 82 securely against its valve seat 140, whereby the sleeve 53, which rides on the tube 32, remains in its lowered condition illustrated in FIG. 3 as the gas pressure in the container builds up.

Turning to FIG. 4, eventually the gas pressure in the container 14 reaches the level of the gas pressure in the bowl 12. There is no longer a pressure differential across the valve element 82 and the spring 120 now exerts sufficient biasing force to lift the liquid flow valve element 82 off the valve seat 140, thereby opening the liquid feeding orifice 142 for liquid in the bowl to exit through the orifice 142 into the container 14. The elevation of the sleeve 53 along with the tube 32 slightly compresses the spring 57, but that spring is much weaker than the spring 120, whereby the compression of the spring 57 is accomplished without interference. Now, the tops of both of the sleeves 42 and 53 press against the cam 192. The abutments 102, 104 limit the height to which the liquid flow valve element 82 and the tube 32 may rise.

The liquid in the filling bowl 12 now enters through the enlarged feeding ports 28 in the lower section of the housing 20, flows over the liquid flow valve element 82, past the gasket 86 and the valve seat 140, through the filling orifice 142 and the filter 146 and enters the container 14. As liquid flows into the container 14 through the liquid feeding orifice 142, the gas in the container 14 is displaced by the inflowing liquid through the openings 38 back into the bowl 12. Eventually, the level of the liquid in the container rises over the openings 38 blocking further outflow of gas from the container 14, which prevents more liquid from entering the container and thereby establishes the level to which the container is filled. The container remains in this condition until, after a predetermined time period has elapsed, the operator 202 is again rotated to the condition illustrated in FIG. 2, which moves the guide sleeve 53 down, which drives down the tube 32 and thereby closes the liquid filling valve 82, 140 and also moves the sleeve 42 down so that the closure element 60 again seats in the opening 37. This precludes further passage of either gas or liquid into or out of the bowl 12 and the container 14.

Before removal of the container 14 from the filling bell 160, the valve 152 of the snift block 130 is operated to exhaust gas at elevated pressure from the container 14, returning the gas pressure in the container to atmosphere. The container 14 is then removed from the bell and capped as appropriate.

The foregoing description assumes proper operation of the filling valve, assumes that the container has been in place during the entire filling operation and assumes that the container has not been removed or broken during filling. Once the cam 192 is in its orientation of FIGS. 3 and 4 and once the flow valve element 82 has lifted up to its condition illustrated in FIG. 4, if the container 14 is prematurely removed, liquid under pressure in the bowl 12 might pour out the filling orifice 142. However, liquid flow is immediately cut off.

Figure 5:
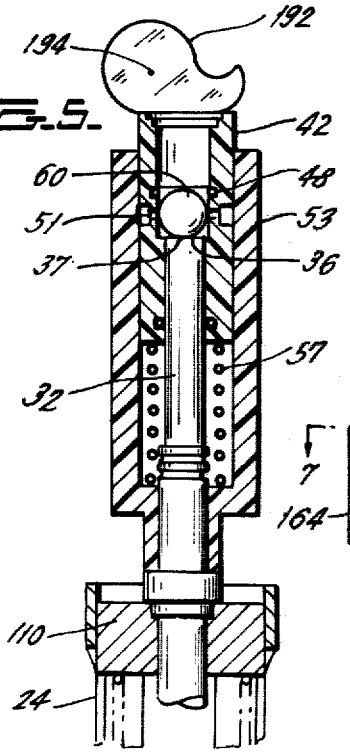
FIG. 5 is the same type of view as FIG. 3, showing the filling valve after it has reacted to the unexpected absence of a container to be filled at the filling valve.

If the container 14 suddenly becomes absent, with the filling valve 10 in the condition illustrated in FIG. 4, a large pressure differential suddenly develops between the interior of the bowl 12 and the underside of the flow valve element 82. Referring to FIG. 5, the pressure of outrushing liquid flow past the valve element 82, the pressure differential acting on the flow valve element 82 and on the piston 110 cooperate to rapidly move the flow valve element 82 down against the valve seat 140. The piston 110 can shift slightly away from the collar 112 following impact, whereby the inertia of the heavy piston 110 will not damage the conduit 30. Once the seat 140 is contacted by the flow valve element, the pressure differential between the interior of the bowl 12 and the underside of the flow valve element 82 which is facing atmospheric pressure securely holds the flow valve element 82 in fluid sealing engagement with the seat 140 precluding further liquid outflow from the bowl.

When the liquid flow valve element 82 rapidly descends to the seat 140, it moves the tubes 32, 34 along with it. However, because the sleeve 42 still remains upraised, the gas flow conduit 30 has not been reclosed, and gas under pressure would continue to exit from the bowl 12 through the opening 37 and the openings 38 until the cam 192 is restored in its proper timed sequence to the condition illustrated in FIG. 2. Compare FIGS. 3 and 5, in which the sleeves 42 and 53 are at the same orientations. The great gas pressure differential between the elevated gas pressure in the bowl 12 and the lower gas pressure at the openings 38, which are now uncovered due to the absence of a container 14, creates a great suction force in bore 47 toward openings 38. The gas pressure differential similarly draws gas into bore 47 through openings 52 in the tube 32 and this rapid gas flow beneath closure element ball 60 acts like a Venturi beneath the ball 60 and sucks the ball toward and against the upper end 36 of the tube 32. Both of the just described pressure differential caused suction forces suddenly drive the closure element ball 60 down against its supporting O-ring biasing means 48 and causes the closure element 60 to override the O-ring 48 and settle into and immediately seal the opening 37 closed. The gas pressure differential securely holds the closure element 60 in place. In the condition of FIG. 5, therefore, both liquid flow and gas flow have been cut off.

As noted above, after the passage of a prescribed time, when the cam element 192 returns to its condition illustrated in FIG. 2, it forces the sleeve 42 downwardly. Because the closure element 60 is pressing against the top 36 of the tube 32 while the sleeve 42 is moving down, the closure element squeezes and then snaps past the biasing means O-ring 48 to return to its condition shown in FIGS. 2 and 3 with the closure element above the O-ring. Therefore, with the cam element in its condition illustrated in FIG. 2, as before, both the gas flow conduit 30 and the liquid flow valve element 82 have been sealed closed. The exit of gas and liquid from the bowl 12 are halted and the filling valve 10 according to the first embodiment of invention is in condition to go through the next container filling cycle.

A second form of cover or capping means 240 is shown in FIGS. 10–13. Elements thereof which correspond in function to elements in the first embodiment of cover or capping means 40 are so far as possible, correspondingly numbered with reference numerals raised by 200. (Other parts, with reference numerals above 260, do not correspond to FIG. 2.)

In this embodiment of cover or capping means 240, as shown in FIG. 10, the sleeves 253 and 53 (of FIG. 2) are structurally identical. The sleeve 242, however, differs from the sleeve 42 (of FIG. 2) in a number of respects. The sleeve 242 is, of course, driven upwardly with respect to the sleeve 253 and by the compression spring 257. The biasing means 248 for the closure element 260 comprises a tension spring having one end 262 secured, as described further below, to the closure element ball 260 and having the other end secured to a supporting set screw 264. The interior of the upper portion 247 of the sleeve 242 is internally threaded and the set screw 264 is externally threaded to enable the set screw 264 to be screwed into and supported in the sleeve 242. The biasing means 248 seeks to hold the closure element 260 in its upraised condition illustrated in FIGS. 10 and 11. The sleeve 242 is provided with a first set of openings 270 generally below the closure element ball 260. These openings are located to be between the ball 260 and the opening 37 when the ball is upraised in the position of FIGS. 11 and 12. The sleeve 242 is also provided with a second set of openings 272 generally above the closure element ball 260 and further from opening 37 than the ball 260. The openings 270, 272 provide access for gas to flow between the bowl 12 and the opening 37 at the top of tube 32, and also helps to drive the closure element 260 down under certain circumstances, as described below.

With the cam 192 in its condition of FIG. 10, which corresponds to the condition thereof in FIG. 2, both of the sleeves 242 and 253 are pushed downwardly and the sleeve 253 holds the liquid flow valve element 82 (not shown in this Figure) closed while the closure element 260 seals closed the opening 37 in the tube 32.

When the cam 192 moves to its condition of FIG. 11, as in the condition of FIG. 3, the sleeve 253, along with the flow valve element 82 and the tube 32, moves downwardly with respect to the sleeve 242. Since the tube 32 moves down with the flow valve element 82, it is drawn away from the closure element ball 260, which remains upraised along with its sleeve 242 which is held up by the compression spring 257. This opens the tube opening 37 and permits gas in the bowl 12 to flow at least through the openings 270 and perhaps also through the openings 272 through the tube 32 and into the container 14 (not shown).

When the container gas pressure rises to the level of the gas pressure in the bowl 12, as shown in FIG. 12, the sleeve 253 and with it the tube 32 and the flow valve element 82 rise so that the upper end of the sleeve 253 also contacts the cam 192. Now liquid can flow into the container 14 while gas exits therefrom through the tube 32 and through the opening 37 back into the bowl 12. There is enough clearance between the sleeves 242 and 253 for gas exiting from openings 270 to pass out of sleeve 253. At the conclusion of the cycle, the cam 192 returns to its original position of FIG. 10, and the container 14 is removed following operation of the snift block 130 in the manner described above.

Turning to FIG. 13, which corresponds to the condition illustrated in FIG. 5, if the container 14 suddenly becomes absent due to breakage or the like, the sleeve 253, tube 32 and flow valve element 82 move downwardly and close off the liquid flow, as described above.

The sudden gas pressure differential between the inside of the bowl 12 and at the opening 37, on the one hand, and at the openings 38, on the other hand, causes gas under pressure to enter the sleeve 242 through the openings 270 and 272. Gas under pressure at the openings 272 drives the closure element ball 260 downwardly to the opening 37. The gas rapidly moving through the sleeve openings 270 into the tube opening 37 to pass out the openings 38 acts like a Venturi beneath the closure element 260 and sucks the ball toward and against the upper end 36 of the tube 32 where the closure element seats in the opening 37 and seals it. These pressures on the closure element 260 are far stronger than the biasing force which the biasing means tension spring 248 is capable of exerting and the tension spring is stretched, as illustrated in FIG. 13. Now, exit of both liquid and gas from the bowl 12 is precluded.

Eventually, at the appropriate time during the cycle, the cam 192 returns to its original condition of FIG. 10, shifting the internal sleeve 242 downwardly to the condition illustrated in FIG. 10. The tension spring biasing means 248 is compressed from its extended condition of FIG. 13 to that of FIG. 10 while the closure element 260 remains in position to seal the opening 37 in the tube 32. The filling valve cover or capping means 240 is now ready for the next cycle.

The closure element 260 is capable of being held to the biasing means spring 248 in a number of different ways. In FIG. 14, the connection at the end 262 of the spring 248 is accomplished by means of an annular groove 276 which is milled into the closure element ball 260 for receiving and holding the end 262 of the spring.

FIG. 15 shows an alternative or a supplemental way of holding the closure element 260 in that the end 262 of the biasing means spring 248 is secured by an annular bead 278 of solder that holds the spring and the closure element ball together. Other techniques of fastening the closure element 260 and the spring biasing means 248 can be envisioned.

Yet another embodiment of cover or capping means 300 is illustrated in FIGS. 16–19. In these Figures, those elements that are the same as in the first embodiment are identified by the same reference numerals. The only change between this third embodimemt and the first embodiment of FIGS. 2–5 is in the provision of a substitute for the external sleeve 53 of the first embodiment. The closure or capping means 300 includes the sleeve 42 of the first embodiment.

A sleeve 302 is permanently and non-shiftably installed so that its lower end 304 rests on the upper end of the filler valve housing 20. The sleeve 302 has a floor 306 on which the compression spring 57 rests and it has a plurality of openings 308 therethrough, through which the filler valve element drive pins 316, described below,, may pass. The sleeve 302 has upstanding side walls for guiding the motion of the below described filler valve shiftable sleeve 310.

Inside the sleeve 302 is installed the axially shiftable sleeve 310. The sleeve 310 has a bore 312 therethrough in which the closure element supporting sleeve 42 is received. The lower end of the sleeve 310 is provided with the drive pins 316 which pass through respective openings 308 and with which the openings 308 are aligned. The lower ends 318 of pins 316 are adapted to drivingly engage the piston 110. In fact the piston 110 and the sleeve 310 generally move together as one unit.

There is interposed between the piston 110 and the pins 316 the additional piston 320 which has an opening therethrough that surrounds the tube 32 and which has a cutout 322 at the base thereof for receiving the collar 112. The piston 320 normally rests on the piston 110 and moves together with it, whereby the entire unit comprised of the pistons 110, 320 and the pins 316 and sleeve 310 all move together as one unit. This combined unit is, therefore, the same in movement and, also, in function as the above described sleeves 53 and 253.

Figure 16:
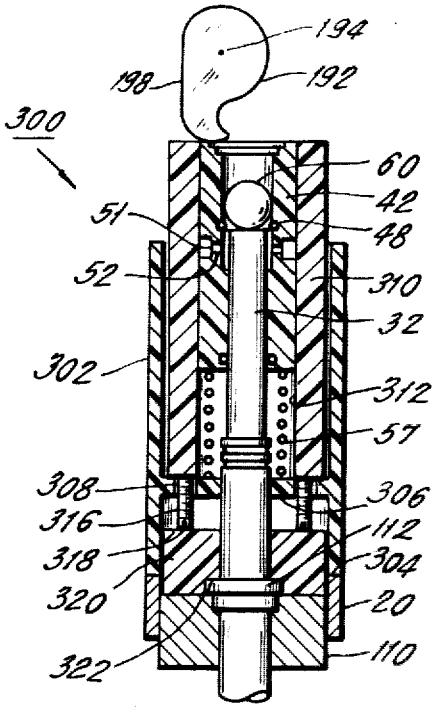
FIG. 16 is the same type of view as FIG. 10 and showing a third embodiment of filling valve in the condition illustrated in FIGS. 2 and 10.

When the cam 192 is in its condition of FIG. 16, the sleeve 42 is down, which has the same effect as described in connection with FIG. 2. The sleeve 310 is also down, to or near the floor 306 in the sleeve 302. This pushes the piston 110 down and closes the flow valve element 82.

Figure 17:
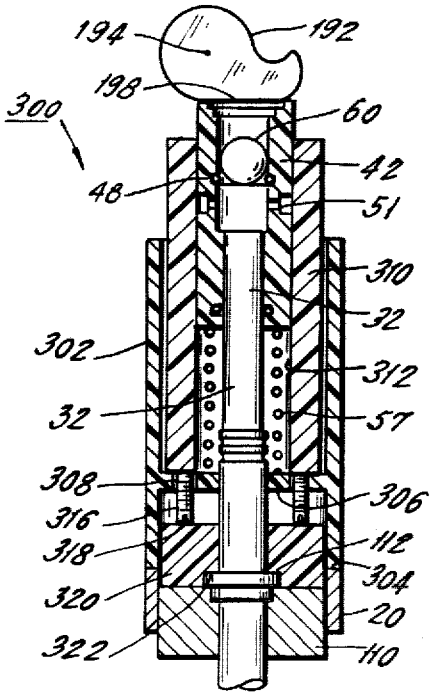
FIG. 17 is the same type view as FIG. 16 showing that filling valve in the condition illustrated in FIGS. 3 and 11.
Figure 18:
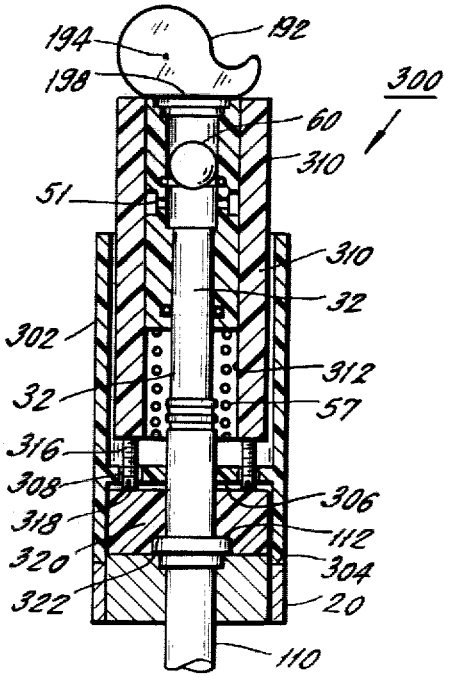
FIG. 18 is the same type of view as FIG. 16 showing that filling valve in the condition illustrated in FIGS. 4 and 12.

When the cam 192 shifts to the condition illustrated in FIG. 17, which corresponds to FIGS. 3 and 11, although the sleeve 42 is permitted to rise, the sleeve 310, piston 110 and flow valve element 82 remain down, for the reasons discussed above. Turning to FIG. 18, when the gas pressure in the container 14 rises to the level of the gas pressure in the bowl 12, the flow valve element 82 is enabled to rise. Contrasting FIGS. 17 and 18, the piston 110 rises with respect to the housing 20, which correspondingly raises the piston 320 and the pins 316 and therefore the sleeve 310, until the latter sleeve contacts the underside of the cam 192.

Figure 19:
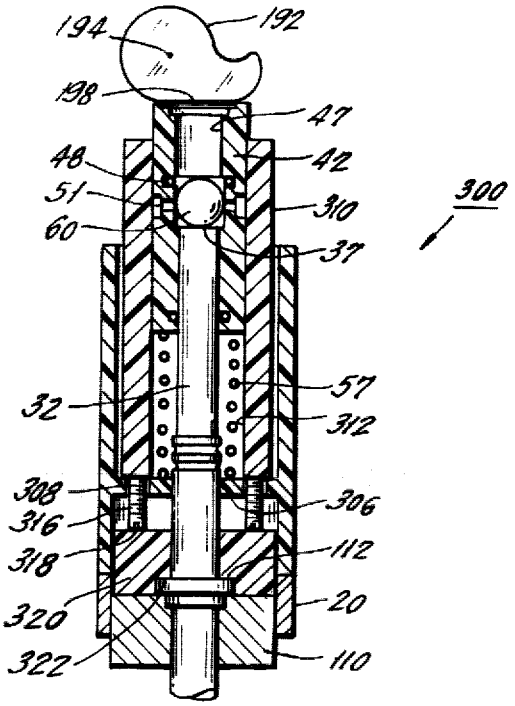
FIG. 19 is the same type of view as FIG. 16 showing that filling valve in the condition illustrated in FIGS. 5 and 13.

Turning to FIG. 19, in the event that a container 14 suddenly becomes absent, as in the first embodiment, the flow valve element 82 immediately shuts the feeding orifice 142, which moves the piston 110 down. This frees the sleeve 310 to be moved down, although such motion of the sleeve 310 is not required at this time. The gas pressure that develops in the bore 47 of the sleeve 42 forces the closure element ball 60 past the O-ring 48 which had been holding the closure element 60 up and seals the upper end opening 37 of the tube 32, as in the first embodiment. As with the first embodiment, at the correct time of the cycle, the cam 192 returns to its condition of FIG. 16 and the closure element 60 is raised above the biasing means O-ring 48 to restore to its original condition.

Another embodiment, which is not illustrated, comprises the just described external sleeve arrangement 302, 310, 320 of the third embodiment but would substitute the sleeve 242 and biasing means 248 of the second embodiment for the sleeve 42 and biasing means 48 in the third embodiment. An embodiment of this type would operate in substantially the same manner as the second embodiment.

A fourth form of cover or capping means 400 is illustrated in FIGS. 20–24. In these Figures, those elements of the capping means that are the same as in the first embodiment of cover or capping means 40 or which correspond in function to elements in the first embodiment are, so far as possible, correspondingly numbered with reference numerals raised by 400. Other parts with reference numerals above 500 do not correspond to elements of any of the previous embodiments.

The external sleeve 453 has substantially the same structure as the sleeves 53 and 253 described above. Formed in its walls are the longitudinally extending slits 455 which permit access into the sleeve for the pressurized gas in the bowl 12.

The internal sleeve 442 differs from the above described sleeve 42 in a number of respects. The sleeve 42 is of a diameter such that it is slidingly received in and guided for movement along the interior surface of the sleeve 53. The sleeve 442, on the other hand, is slightly narrower in external diameter than the internal diameter of the sleeve 453. The interior wall 451 of the sleeve 453 has two annular, axially spaced apart grooves formed therein, an upper groove 502 and a lower groove 504. The placement and spacing of these grooves is selected for reasons discussed below. In each of these grooves is fixedly positioned a respective stiff but resilient O-ring 506 and 508. The external diameter of the sleeve 442 is selected so that the sleeve 442 is substantially gas-tight sealed against the O-rings 506, 508 but is able to shift axially under mechanical forces and spring pressure with respect to the sleeve 453, as described further below. The spring 457 normally urges the sleeve 442 upwardly out of the sleeve 453, but such movement is restrained by the below-described cam 532 of the filling valve lever.

Inside the sleeve 442, there is an annular groove 447 for receiving the O-ring 448. This ring supports the closure element ball 460, so that the closure element ball will normally rise and descend with the sleeve 442 and so that the closure element ball may snap down to seat in the opening 37 in the tube 32 upon a container 14 suddenly becoming absent.

Inside the top of the bore of the sleeve 442 is defined an annular groove 512 in which a spring clip 514 is positioned. This simply locks the closure element ball 460 in the sleeve 442 to prevent undesired exit thereof from the sleeve.

Immediately beneath the groove 512 is at least one hole 516 for providing communication from the exterior to the interior sleeve 442 above the closure element 460, and the hole 516 performs a similar function to the holes 272 in FIG. 10.

Arrayed beneath the O-ring 448 are a plurality of holes 518 that pass through the sleeve 442 and that can serve the same function as the holes 270 in FIG. 10. The placement and spacing of the O-rings 506, 508 is selected so that when the cover or capping means 400 shifts into the position of FIG. 23, which occurs upon a container 14 suddenly becoming absent, the O-rings 506, 508 straddle the annular array of holes 518 and effectively nearly seal the holes closed against gas passage therethrough, which facilitates the closing of the filling valve, as described further below.

The other major structural difference between the previously discussed embodiments and the present embodiment is the provision of two separate, differently profiled cams 530, 532 for positively operating both of the sleeves 453, 442, respectively. Both of these cams are connected with the single rotatable drive shaft 533, which rotates both cams together. The operator 402 external to the bowl 12 for the shaft 533 rotates the cams 530 and 532.

The cam 530 for the external sleeve 453 may be profiled like the cam 192 and will pivot around a respective pivot at the same location as pivot 194. In the one orientation of the cam 530 in FIG. 20, it drives the respective sleeve 453 downwardly, and as the cam is moved toward its other orientation of FIGS. 21–23, it permits the sleeve 453 to rise with the liquid flow valve element 82.

Figure 20:
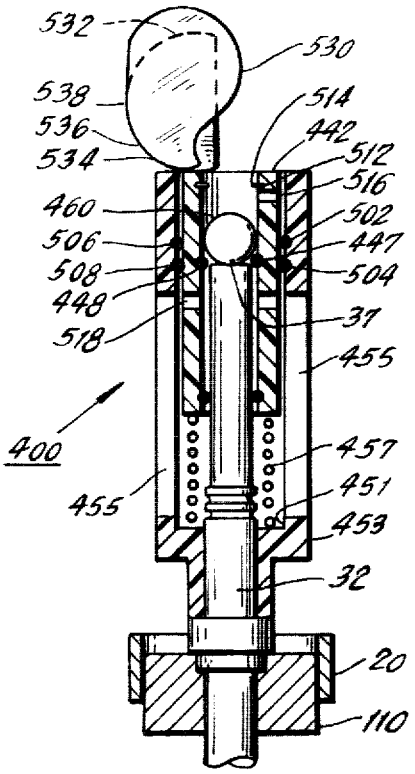
FIGS. 20, 21, 22, 23 are views corresponding respectively to those of FIGS. 16, 17, 18 and 19 showing a modified form of capping means.
Figure 21:
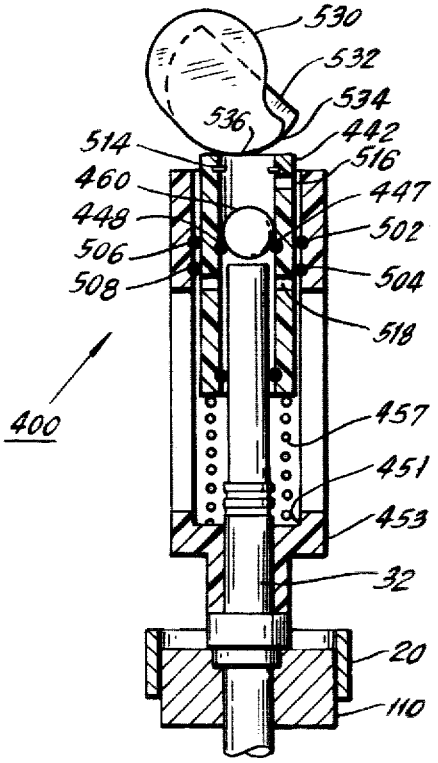

The cam 532 for the internal sleeve 442 is profiled to permit the sleeve 442 to rise up a short distance immediately as the cam 532 starts rotating from the position of FIG. 20 to that of FIG. 21. Once the cam 532 moves to its position of FIG. 22 it permits the sleeve 442 to rise slightly still further and the cam 532 thereafter holds the sleeve 442 at the second slightly elevated condition. To this end, the cam 532 is profiled to have an eccentric shape with a larger radius section 534, followed by a smaller radius section 536, which maintains the sleeve 442 at its slightly elevated condition of FIG. 21. As the cam 530 rotates to permit the sleeve 453 to rise high to the position of sleeve 453 in FIG. 22, when pressure in container 14 finally permits it, then the cam 532 has a further still smaller radius section 538 which permits the sleeve 442 to rise slightly from its position of FIG. 21 to its position of FIG. 22 when the sleeve 453 is also rising.

With both cams 530, 532 in their conditions of FIG. 20, which corresponds to the condition of the cam shown in FIG. 2, both of the sleeves 442 and 453 are pushed fully downwardly, and the sleeve 453 holds the liquid flow valve element 82 (not shown in this Figure) closed while the closure element 460 seals closed the opening 37 in the tube 32. In this position, the O-ring 448 is positioned just low enough so that it is beneath the closure element ball 461, and that ball is resting on and closing the opening 37.

In the condition of FIG. 21, the cam 532 for the internal sleeve 442 has rotated slightly onto section 536, just enough to permit the spring 457 to drive the sleeve 442 upwardly a quite short distance with respect to the sleeve 453. This raises the O-ring 448 to lift the closure element ball 460 off the opening 37 and permits the gas in the filling bowl 12 to move in through the slits 455 and up the interior of the sleeve 453 through the holes 518 in the sleeve 442. In contrast with the prior embodiments, the cam 532 is profiled to prevent the sleeve 442 from rising all the way up. Otherwise the holes 518 might then be between the O-rings 506, 508 which would seal against the passage of air through the holes for pressurizing the container 14. Alternatively, the sleeve 442 might rise so high that the holes 518 would be above the upper O-rings 506. In the latter case, there would be a period of passage of the holes 518 from beneath the lower O-ring 508 to above the upper O-ring 506 where the holes 518 would be sealed between the O-rings and this would preclude the filling valve reacting properly to the absence of a container 14 during that period of passage. Thus, the cam 532 prevents the sleeve 442 from rising above that small distance just described in order for the filling valve to properly and fully operate. This small movement could occur rapidly, thereby enabling the entire cover means 400 to operate quite rapidly.

As the cam 530 is moved to its position of FIG. 21, the cam 530 lifts off the top of the sleeve 453. But, sleeve 453 stays down because the container pressure is still lower than the bowl pressure.

Figure 22:
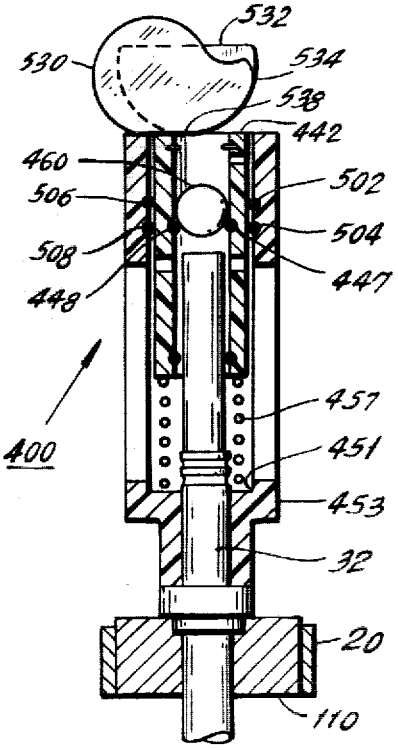
Figure 24:
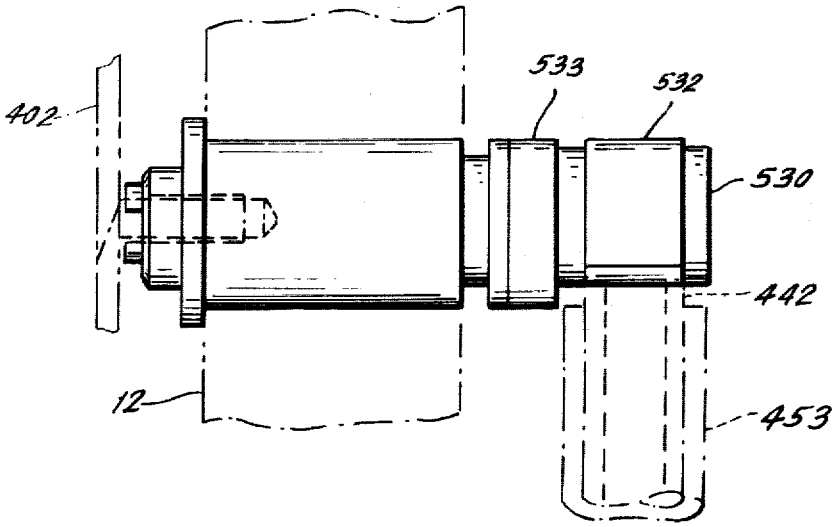
FIG. 24 is a view taken from the right-hand side of any one of FIGS. 20 to 23 showing the method of connection of the operating member to the mechanism.

The shaft 533 continues to turn the cams to their position of FIG. 22. As the cam 532 rotates, its smaller radius section 538 permits the internal sleeve 442 to rise slightly from the position of FIG. 21. This positions the sleeve 442 properly in the event of a sudden reclosing, the condition shown in FIG. 23. At the position of FIG. 22, the bottom surface of the cam 530 now defines the upper limit of the subsequent upward movement of the sleeve 453.

When the gas pressure in the container 14 rises to the level of the gas pressure in the bowl 12, then as shown in FIG. 22, the sleeve 453 and with it the tube 32 and the flow valve element 82 rise so that the upper end of the sleeve 453 again contacts the cam 530. Now liquid can flow into the container 14 while gas exits therefrom through the tube 32 and through the opening 37 back into the bowl 12. There is enough clearance between the sleeves 442 and 453, especially because of the spacing therebetween due to the thickness of the O-rings 506, 508, for gas passing up through the tube 32 to exit through the holes 518 beneath lower O-ring 508 and pass back into the bowl 12.

At the conclusion of a normal filling cycle, the cams 530 and 532 return to their initial positions of FIG. 20, and the container 14 is removed following operation of the snift block 130, in the manner described above.

Figure 23:
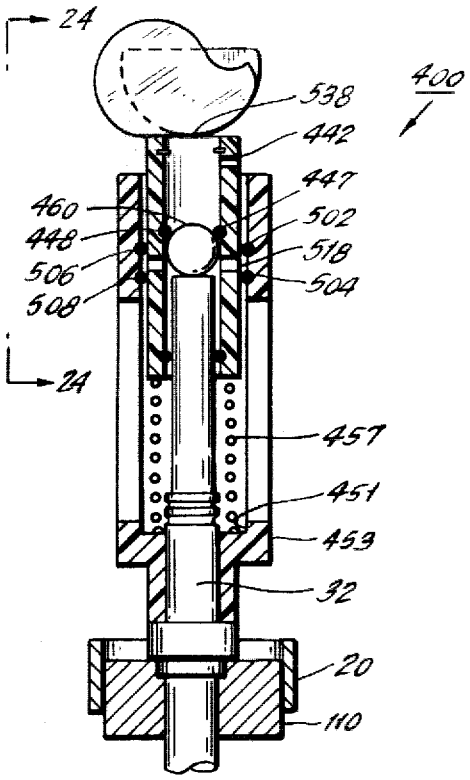

Turning to FIG. 23, which corresponds to the condition illustrated in FIG. 5, if the container 14 suddenly becomes absent due to breakage, or the like, the sleeve 453, tube 32 and flow valve element 82 all return downwardly and close off the liquid flow, as described above. The downward movement of the sleeve 453 does not cause corresponding downward movement of the sleeve 442. Instead, the spring 457 is strong enough to continue urging the sleeve 442 up against the section 538 of the cam 532. The downward movement of the sleeve 453 moves the O-rings 506, 508 down until the lower O-ring 508 passes the holes 518. The holes 518 are now straddled by the O-rings 506, 508 and are effectively gas-sealed.

While the sleeve 453 is descending and after it has descended as just described, the sudden gas pressure differential between the inside of the bowl 12 and at the opening 37 of the tube inside the bowl, on the one hand, and the gas pressure at the tube openings 38, on the other hand, causes gas under pressure to enter the top of the sleeve 442 and also to enter the hole 516, which are both above the closure element ball 460 that is still resting on the O-ring 448. Contrary to the embodiment of FIG. 10, because the holes 518 are sealed, there is no gas flow beneath the closure element 460, which would serve as a Venturi. The gas pressure above the closure element 460 still resting on the upraised O-ring 448 is stronger than the biasing, lifting force which the O-ring 448 is capable of exerting and the ball 460 above the biasing means O-ring 448 eventually deforms it until the closure element 460 snaps down past the O-ring 448 and onto the upper end 36 of the tube 32 where the closure element seats in the opening 37 and seals it. Now, exit of both liquid and gas from the bowl 12 are precluded.

Eventually, at the appropriate time during the cycle, both of the cams 530 and 532 return to their initial conditions of FIG. 20, shifting both the internal sleeve 442 and the external sleeve 453 down to their initial conditions of FIG. 20. As the sleeve 442 descends, the O-ring 448 engages the closure element 460 from above, and the O-ring is deformed as the O-ring pushes and snaps past the closure element 460, thereby returning the O-ring to its original position beneath the closure element 460. The closure element 460 remains in its down position, sealing the opening 37 in the tube 32. The filling valve cover or capping means 400 is now ready for the next cycle.

A fifth form of cover or capping means 600 is illustrated in FIGS. 25–28. In these Figures, those elements of the capping means that are the same as in the first embodiment of cover or capping means 40 or which correspond in function to elements in the first embodiment are, so far as possible, correspondingly numbered with reference numerals raised by 600.

The external sleeve 653 functions similarly to the sleeves 53, 253 and 453. However, structurally, it is somewhat different in view of the changed construction of the present embodiment. There are slits 655 longitudinally extending along the sleeve 653, which permit access into the sleeve 653 for the pressurized gas in the bowl 12.

The sleeve 653 has a widened base portion 702 for being slidingly received in the below described filler valve extension sleeve 760. The base portion 702 also includes longitudinally extending slots 704 formed at diametrically opposite positions around the sleeve base portion 702. The slots 704 are long enough so that the below described bridge portion 762 of the extension sleeve 760 can pass through the slots 704 with clearance and so that the sleeve 653 can shift axially through the extension sleeve 760 and with respect to the bridge, without the bridge striking the top or bottom ends of the slot 704, which would interfere with the movement of the sleeve 653.

The base 706 of the sleeve 653 sits on the split ring platform 770, described below, which is tightly secured to the stem 632 and is, therefore, effectively a part of the stem. With the sleeve 653 sitting on the platform 770 and with the platform being part of the stem 632, the sleeve 653 is anchored to the stem 632 and moves with it and is, in effect, part of the stem.

The exterior of the stem 632 is developed somewhat differently than the exterior of the stem 32. A pair of spaced apart grooves 708, 710 are defined on the stem at axially spaced locations along the height of the sleeve base portion 702. The sleeve base portion 702 has its own cooperating, respective internal grooves 712, 714 which respectively are alignable with the grooves 708, 710. A respective O-ring 716 is captured in the cooperating grooves 708, 712 and a respective O-ring 718 is captured in the respective cooperating grooves 710, 714. By this O-ring connection between the sleeve base portion 702 and the stem 632, the outer sleeve 653 is further anchored to the stem 632. In this respect, the exterior sleeve 653 is like the exterior sleeve 453 which, as shown in FIG. 20, is also anchored to the cooperating stem 32.

The interior of the exterior sleeve 653 near the top thereof is provided with two axially spaced apart grooves 720, 722, each of which permanently holds a respective O-ring 724, 726. The purpose of these O-rings will be described below.

In order to hold the exterior sleeve 653 securely to the stem 632, so that they do not shift axially with respect to each other during long use of the filler valve 600, the platform 770 for the external sleeve 653 comprises a split retaining ring which is comprised of the two sections 772, 774 substantially semi-circular in cross-section. The platform 770 includes the shelf 776 upon which the sleeve 653 sits, the upraised central positioning flange 777 and the depending tubular portion 778 having the opening 779 in it in which the tube 632 is received. There is a receiving opening 780 inside the piston 110 which is dimensioned to squeeze the split retaining ring 772, 774 securely against the tube 632 and this so tightly clamps the platform 770 to the tube 632 that they become one unit. Neither the platform 770 nor the sleeve 653 may shift axially with respect to the stem 632, but instead they all shift together.

The internal sleeve 642 is quite similar to the above described internal sleeve 442.

The internal sleeve 642 includes an internal groove 730 for permanently receiving and holding the O-ring 732 therein toward the middle of the sleeve. The O-ring cooperates with the closure element ball 660 for normally supporting that ball above the upper end of the stem 632 and for permitting the closure element ball 660 to descend past the O-ring 732 upon a container 14 to be filled undesirably becoming absent.

An O-ring 733 supported inside the sleeve 642 near the bottom engages the stem 632 for guiding the motion of the sleeve with respect to the stem 632. Therefore, the O-ring 733 does not have a tight fit with the stem 632.

Inside the top of the bore of the sleeve 642 is defined an annular groove 738 in which a spring clip 742 is positioned. This simply locks the closure element ball 660 in the sleeve 642 to prevent undesired exit thereof from the top of the sleeve.

Beneath the groove 738 is at least one hole 744 (FIG. 27) for providing communication from the exterior into the interior sleeve 642 above the closure element 660. The hole 744 performs a similar function to the holes 516 and 272, described above.

Figure 28:
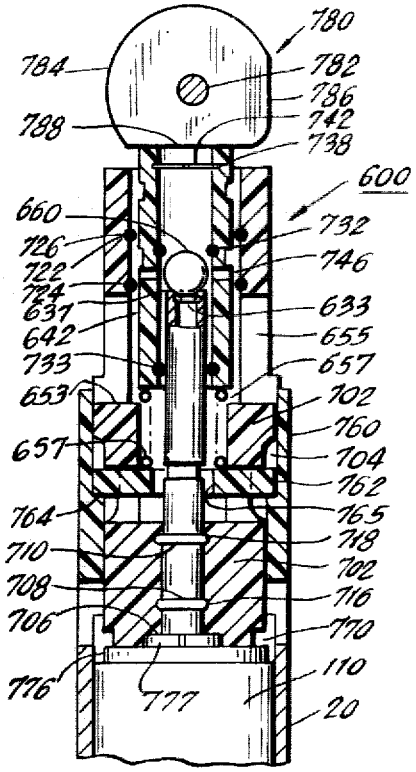

Arrayed beneath the O-ring 732 are a plurality of holes 746 that pass through the sleeve 642 and that can serve the same function as the holes 518 in FIG. 20. However, the placement and spacing of the O-rings 724, 726 are selected so that the O-rings 724, 726 cannot straddle the annular array of holes 746 except in the case when container becomes missing (FIG. 28).

Just inside the top 637 of the tube 632 there is a rubber O-ring 633 held in a groove so that when the closure element ball 660 seats down against the top of the tube 632, a tight seal is made for closing off the tube 632 due to the engagement between the closure element ball 660 and the ring 633.

In the prior embodiment, the spring 457 operates on the bottom of the sleeve 442 to normally drive that sleeve up against the cam 532. As a result, the spring 457 acts against the sleeve 453 which, in turn, through the piston 110 communicates with the spring 120. Therefore, the springs 120 and 457 act in opposition to each other and thereby cause the motion of the sleeve 442 to be controlled by two counteracting springs. This makes the action of this sleeve 442 needlessly unpredictable.

In the present embodiment, the housing 20 has an external support sleeve 760 normally seated on it and immovable with respect to it, whereby the support sleeve 760 is, in effect, a part of the stationary housing 20. The internal sleeve 642 communicates through the compression spring 657 beneath the sleeve 642 with the supporting bridge element 762 that rests on the shelf 764 inside the support sleeve 760. Because the spring 657 is compressed between the sleeve 642 and the bridge 762, the bridge 762 is normally continuously held on the shelf 764, making it in effect an integral part of the support sleeve 760 which, in turn, makes it part of the housing 20. The bridge 762 has a central clearance opening 765 through it to permit unencumbered through passage of the stem 632. With the spring 657 sitting on the bridge 762, the spring 657 operates in opposition to the fixed housing 20 and not in opposition to a movable piston 110 and another spring 120, whereby the motion of the sleeve 642 is rendered more predictable.

In addition, as noted above, the support sleeve 760 guides the axial shifting of the external sleeve 653. Because the external sleeve 653 shifts axially with respect to the stationary support sleeve 760, 762, the above noted clearance openings 704 in the opposite side walls of the external sleeve 653 permit the external sleeve 653 to shift axially without interference.

The cam 780 is operated to rotate in the same manner as the cams described above. The cam 780 has three major sections of different diameters, as measured from the axis of rotation 782 of the cam. The widest diameter section 784 holds the internal sleeve 642 down, which seats the closure element ball 660 in the top of the tube 632 and against the ring 633, thereby sealing against leakage flow of gas out of the bowl. Upon counterclockwise rotation of the cam 780 far enough, the first smaller diameter flat 786 moves into engagement with the top of the internal sleeve 642 and the spring 657 drives the internal sleeve to rise up against the flat 786. This is the initial, gas fill position. The second flat 788 which is of even smaller diameter than the flat 786 enables the internal sleeve 642 to rise high enough so that gas transfer through tube 632 can continue and also so that the upward shifting of the external sleeve 653, which occurs upon gas pressure in the container 14 rising to the level of gas pressure in the bowl 12, will not be prevented.

Figure 25:
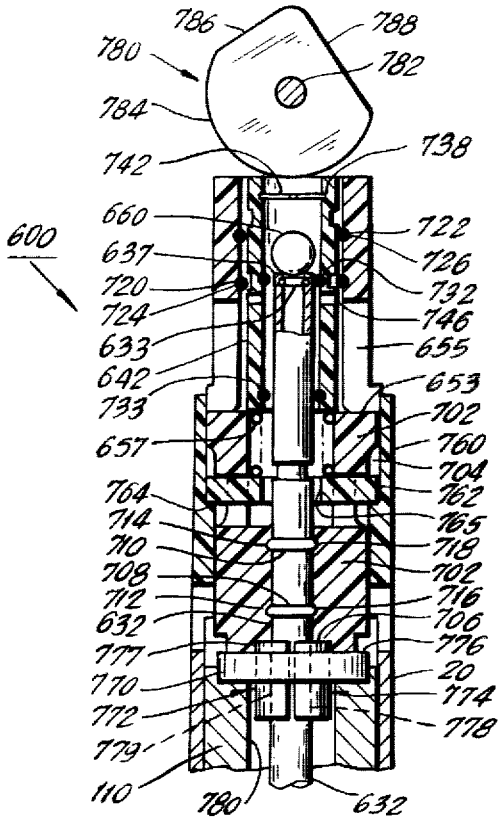
FIGS. 25, 26, 27 and 28 are views showing another modified form of operating mechanism including the cover or capping means corresponding with modifications as hereinafter described to the structures shown in FIGS. 20 to 23 and FIGS. 6 to 18.

With the cam 780 in its condition of FIG. 25, which corresponds to the condition of the cam shown in FIG. 2, both of the internal sleeve 642 and the external sleeve 653 are pushed fully down. The larger diameter section 784 of the cam 780 pushes the internal sleeve 642 and the external sleeve down to close the valve completely. The external sleeve is held down by the differential gas pressure between the interior of the bowl 12 in which the valve 600 is positioned and the exterior of the bowl, which is at atmospheric pressure. In this condition, the top 637 of the tube 632 is high enough and the internal sleeve 642 is low enough that the closure element ball 660 is upraised by the top of the tube 632 from its supporting O-ring 732 and the ball seats directly against the ring 633 at the top of the tube 632, thereby sealing the tube 632. The gas pressure in the bowl holds the ball down.

Figure 26:
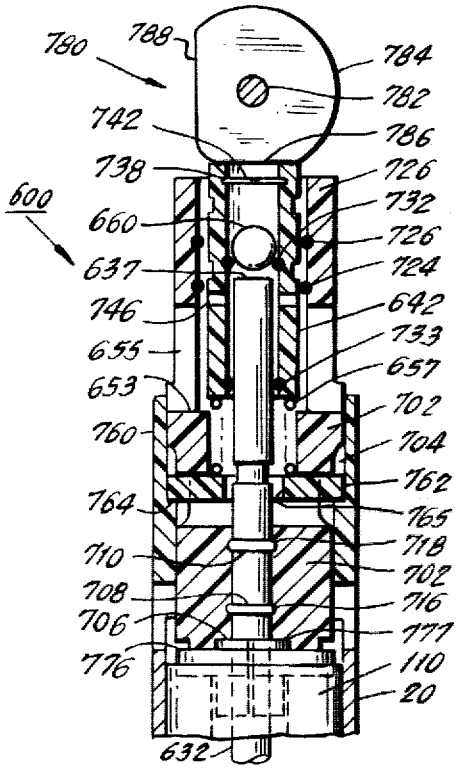

Prior to the movement of the cam to the position illustrated in FIG. 26, a container to be filled is placed beneath the filler valve (not shown in this Figure). In the condition of FIG. 26, the cam 780 has now rotated so that the intermediate diameter flat 786 is resting against the top of the sleeve 642. The spring 657 keeps pushing up the sleeve 642 so that its top remains in contact with the cam 780. The O-ring 732 in the sleeve 624 lifts the closure element ball 660 off the top end of the tube 632. This permits the gas in the filling bowl 12 to move in through the slits 655 in the exterior sleeve and to pass through the holes 746 in the interior sleeve, and to then enter the top of the tube 632. The external sleeve 653 still stays down blocking liquid outflow from the bowl because the gas pressure in the bowl 12 is greater than the gas pressure in the container 14.

In the condition of FIG. 26, in the event that container 14 suddenly becomes absent from beneath the filler valve, because the liquid flow valve and its sleeve 653 have not yet opened, no liquid escapes. The gas in the bowl 12 will leak out through the tube 632 through the remainder of the cycle illustrated in FIG. 26. The cycle lasts less than a second (for a 2 liter bottle, the cycle last about 1 second; for a 16 oz. bottle, the cycle lasts a small fraction of a second).

Figure 27:
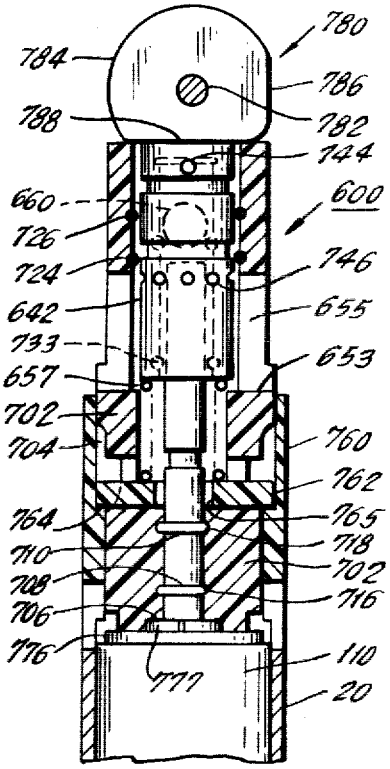

The cam 780 does not actually remain at the position shown in FIG. 26, but continues to rotate until its small diameter flat 788 moves over the top of the inner sleeve 642. During the time that the cam flat 786 is over the top of the sleeve 642 and as the cam is continuing to rotate, the gas pressure in the container 14 reaches the level of the pressure inside the bowl and the sleeve 653 is thereafter freed to move up under the influence of the spring 120 (not shown in this Figure). In the condition of FIG. 27, both the sleeves 642 and 653 are in the same relative positions they were in in the position of FIG. 25, but both are more upraised with respect to the housing 20. The condition of FIG. 27 prepares the filler valve for sudden reclosing in the event of a container becoming absent.

With the filler valve in the condition of FIG. 27, and with the liquid filler valve and the gas fill stem 632 both open, liquid can flow into the container 14 while displaced gas exits from that container through the stem 632, through the holes 746 and through the openings 655 back into the bowl 12.

At the conclusion of a normal filling cycle, the cam 780 returns to its initial condition of FIG. 25. The cam 780 pushes down both of the internal sleeve 642 and together with it the external sleeve 653 to their conditions of FIG. 25. Following return of the filling valve to its condition of FIG. 25, the filled container 14 is removed following operation of the snift block 130, in the manner described above.

Turning to FIG. 28, which corresponds to the condition illustrated in FIGS. 5 and 23, if the container 14 suddenly becomes absent due to breakage, blowing, or the like, while the filler valve is in its condition of FIG. 27, the external sleeve 653, the tube 632 and the flow valve element 82 all return downwardly and close off the liquid flow, as described above. The downward movement of the sleeve 653 does not cause corresponding downward movement of the sleeve 642. Instead, the spring 657 is strong enough to continue urging the sleeve 642 up against the flat 788 of the cam 780. The downward movement of the sleeve 653, moves the O-rings 724, 726 down, straddling openings 746 between the O-rings. Nonetheless, the sudden outrushing flow of gas from the bowl into the tube 632 creates a differential pressure across the closure element ball 660, which pressure differential enters the internal sleeve 642 through the hole 744, and also through the open top of the sleeve 642, which is not completely sealed off by the flat 788 of the cam 780. The pressure from above the closure element ball 660 drives the ball 660 down to the O-ring 732. The gas pressure above the closure element ball 660 is stronger than the biasing, lifting force which the O-ring 732 is capable of exerting, whereby the ball 660 eventually deforms the ring 732 until it moves down past the ring and into secure engagement with the ring 633 at the top of the tube 632, thereby sealing the tube 632 off against leakage flow of gas. Now, exit of both liquid and gas from the bowl 12 are precluded.

Eventually, at the appropriate time during the cycle, the cam 780 rotates again to ring the large diameter section 784 against the top of the sleeve 642 and the sleeves 642, 653 are returned to their initial conditions of FIG. 25.

As the sleeve 642 descends, the O-ring 732 engages the closure element 660 from above, and the O-ring is deformed as it is pushed against and then the O-ring snaps past the closure element 660, thereby returning the O-ring to its original position beneath the closure element 660. The closure element 660 remains in its down position, sealing the opening 637 into the tube 632. The filling valve cover or capping means 600 is now ready for the next cycle.

Although the present invention has been described in connection with a plurality of preferred embodiments thereof, many further variations and modifications will now become apparent to those skilled in the art. It is preferred, therefore, that the present invention be limited not by the specific disclosure herein, but only by the appended claims.

What is claimed is:

1. A filling valve for filling a container with liquid from a pressurized bowl, said valve comprising:

a housing;

a filling orifice through said housing, through which liquid can be fed;

a valve seat in said housing and around said filling orifice;

a liquid flow valve element in said housing and shiftable onto and off said valve seat for selectively closing and opening said filling orifice, respectively;

a gas flow conduit comprising:

a gas flow tube extending from above said liquid flow valve element, through said liquid flow valve element and extending below said liquid flow valve element to be below said valve seat;

a first gas flow opening in said gas flow tube above said valve seat; a second gas flow opening in said gas flow tube below said valve seat; said gas flow tube joining said first and said second gas flow openings;

said gas flow conduit being shiftable axially together with said liquid flow valve element, with respect to said housing;

a cover for closing said first gas flow opening;

said cover comprising:

a closure element shaped for blocking said first gas flow opening and being movable between a first position away from said first gas flow opening and a second position at and blocking said first gas flow opening;

a support for said closure element; first biasing means connecting said closure element support and said closure element for normally biasing said closure element against moving to its said second position; said first biasing means has the characteristic that upon a predetermined gas pressure differential developing between the interior of said bowl at said first gas flow opening, on the one hand, and at said second gas flow opening, on the other hand, said closure element is urged to its said second position by the gas flow through said first gas flow opening to said second gas flow opening, and the bias of said first biasing means is overcome;

second biasing means connecting said closure element support and said gas flow tube for biasing said support in a direction to normally move said closure element away from its said second position.

2. In combination, the filling valve of claim 1 and a pressurized liquid bowl;

said bowl having a lower side and having a hole through said lower side for communicating into said bowl through said lower side;

said filling valve extending through said bowl hole, with said filling valve housing closing said bowl hole; said filling orifice of said filling valve housing comprising an opening through said housing communicating between the interior of said bowl and the exterior of said bowl;

said flow valve element being in that said filling orifice opening, whereby liquid in said bowl passes out of said bowl through said filling orifice opening and past said liquid flow valve element.

3. The combination of claim 2, further comprising cam means in said bowl and being movable to a first orientation for pressing both of said support and said gas flow tube to move toward said bowl hole and thereby also to move said closure element to said second position thereof and to move said flow valve element onto said valve seat; said cam means being movable to a second orientation which enables said closure element support to be moved under the infuence of said first biasing means and frees said gas flow conduit tube to be moved, and both being thus movable away from said bowl hole.

4. The combination of claim 3, wherein said support comprises a sleeve around said gas flow tube; said support having a hollow therein and said support sleeve and its said hollow extending above said first gas flow opening;

said closure element being supported inside said support sleeve hollow and above said first gas flow opening;

said sleeve has a gas flow hole therethrough for communicating from the outside of said sleeve into said sleeve at a location further from said first gas flow opening than said closure element;

blocking means for selectively blocking said gas flow hole upon movement of said flow valve element to said valve seat while said closure element is in said first position thereof and while said cam means is in said second orientation.

5. The combination of claim 4, further comprising a guide sleeve around said closure element support and being movable together with said flow valve element; said blocking means being carried on said guide sleeve for being moved therewith between positions at which said blocking means blocks said gas flow hole and unblocks said gas flow hole.

6. The combination of claim 5, wherein said guide sleeve has a passage therethrough to the exterior thereof, and said blocking means blocking said gas flow hole comprising said blocking means blocking communication between said gas flow hole and said guide sleeve passage.

7. The combination of claim 6, wherein said blocking means comprises a pair of spaced apart sealing elements, which block said gas flow hole by straddling said gas flow hole and which unblock said gas flow hole by both moving beyond said gas flow hole in one direction, for establishing communication between said gas flow hole and said guide sleeve passage.

8. The combination of either of claims 3 or 5, wherein said gas flow tube has a top and said first gas flow opening is at said top of said gas flow tube.

9. The filling valve of either of claims 1 or 2, wherein said gas flow tube has a top and said first gas flow opening is at said top of said gas flow tube.

10. The filling valve of claim 1, further comprising a guide for said closure element support; said guide being connected to said gas flow tube so as to shift axially therewith;

said second biasing means being connected between said guide and said support.

11. In combination, the filling valve of claim 10, and a pressurized liquid bowl;

said bowl having a lower side and having a hole through said lower side for communicating into said bowl through said lower side;

said filling valve extending through said bowl hole, with said filling valve housing closing said bowl hole; said filling orifice of said filling valve housing comprising an opening through said housing communicating between the interior of said bowl and the exterior of said bowl;

said flow valve element being in that said filling orifice opening, whereby liquid in said bowl passes out of said bowl through said filling orifice opening and past said liquid flow valve element.

12. The combination of claim 11, further comprising cam means in said bowl and being movable to a first orientation for pressing both of said support and said gas flow tube to move toward said bowl hole and thereby also to move said closure element to said second position thereof and to move said flow valve element onto said valve seat; said cam means being movable to a second orientation which enables said closure element support to be moved under the influence of said first biasing means and frees said gas flow conduit tube to be moved, and both being thus movable away from said bowl hole.

13. The combination of claim 12, wherein said first biasing means has the characteristic that upon a predetermined gas pressure differential developing between the interior of said bowl at said first gas flow opening, on the one hand, and at said second gas flow opening, on the other hand, said closure element is urged to its said second position by the gas flow through said first gas flow opening to said second gas flow opening, and the bias of said first biasing means is overcome.

14. The combination of claim 12, further comprising a guide for said closure element support; said guide being connected to said gas flow tube so as to shift axially therewith;

said second biasing means being connected between said guide and said support.

15. The combination of claim 14, wherein said cam means continuously engages both of said support and said guide, and movement of said cam means between its said orientations selectively causes said support and said guide to shift together toward said bowl hole and also in the other said orientation thereof permits both said guide and said support to shift away from said bowl hole.

16. The filling valve of claim 10, wherein said support comprises a sleeve around said gas flow tube; said support having a hollow therein and said support sleeve and its said hollow extending above said first gas flow opening;

said closure element being supported inside said support sleeve hollow and above said first gas flow opening.

17. The filling valve of claim 16, wherein said first biasing means comprises a ring supported in said support sleeve hollow and said closure element is shaped to be supported at the side of said ring away from said first gas flow opening;

said closure element and said ring being shaped and being of materials such that upon a predetermined gas pressure differential developing between said first and said second gas flow openings, said closure element may be pulled, by the gas moved by the pressure differential, past said ring to its said second position.

18. The filling valve of claim 16, wherein said first biasing means comprises a spring supported by said sleeve and continuously supporting said closure element;

said spring having the characteristic that with said closure element in its said first position and upon a predetermined gas pressure differential developing between said first and said second gas flow openings, said closure element may be pulled, by the gas moved by the pressure differential to charge said first biasing means spring as said closure element moves to its said second position.

19. The filling valve of claim 18, wherein said spring is attached to said closure element.

20. The filling valve of claim 19, wherein said attachment of said spring and said closure element is by means of a groove formed in said closure element, and a part of said spring being held in said groove.

21. The filling valve of claim 19, wherein said attachment of said spring and said closure element is by means of solder.

22. The filling valve of claim 16, wherein said first biasing means comprises a tension spring and said closure element is normally supported by said tension spring above said first gas flow opening; said tension spring being supported by said sleeve still further from said first gas flow opening than said closure element;

said spring having the characteristic that with said closure element in its said first position and upon a predetermined gas pressure differential developing between said first and said second gas flow openings, said closure element may be pulled, by the gas moved by the pressure differential to charge said first biasing means spring as said closure element moves to its said second position.

23. The filling valve of claim 22, wherein said sleeve has a gas flow hole therethrough for communicating from the outside of said sleeve into said sleeve at a location further from said first gas flow opening than said closure element.

24. The filling valve of claim 22, wherein said sleeve has a gas flow hole therethrough for communicating from the outside of said sleeve into said sleeve between said closure element and said first gas flow opening when said closure element is off said second position thereof.

25. The filling valve of claim 24, wherein said sleeve has a second gas flow hole therethrough for communicating from the outside of said sleeve into said sleeve at a location further from said second gas flow opening then said closure element.

26. The filling valve of claim 22, wherein said spring is attached to said closure element.

27. The filling valve of claim 26, wherein said attachment of said spring and said closure element is by means of a groove formed in said closure element, and a part of said spring being held in said groove.

28. The filling valve of claim 27, wherein said attachment of said spring and said closure element is by means of solder.

29. The filling valve of claim 16, wherein said guide also comprises a sleeve around and supporting said support sleeve within said guide sleeve; said support sleeve being axially shiftable with respect to said guide sleeve;

means connected on said gas flow tube on which said guide sleeve is supported for said guide sleeve being movable with said gas flow tube.

30. The filling valve of claim 10, wherein said guide also comprises a sleeve around and supporting said support within said guide sleeve; said support being axially shiftable with respect to said guide sleeve;

means connected on said gas flow tube on which said guide sleeve is supported for said guide sleeve being movable with said gas flow tube.

31. The filling valve of claim 10, further comprising a piston in said housing and axially shiftable through said housing;

said third biasing means joining said piston with said flow valve element, such that with said piston moving down toward said valve seat, said valve element is moved to said valve seat;

said guide also comprising a sleeve around and supporting said closure element support within it; said support being axially shiftable with respect to said guide sleeve;

said guide sleeve being supported on and movable with said gas flow tube.

32. The filling valve of claim 31, wherein said guide sleeve includes a sleeve portion that engages said gas flow tube for being guided to a predetermined orientation by such engagement.

33. The filling valve of claim 31, further comprising an additional sleeve outside said guide sleeve; said additional sleeve being non-movably supported on said housing; said additional sleeve supporting and orienting said guide sleeve for motion with respect to said additional sleeve.

34. The filling valve of claim 1 wherein said flow valve element is so positioned with respect to said gas flow tube that when said flow valve element is off said valve seat, said flow valve element is relatively near to said valve seat, for enabling liquid moving through said filling orifice to normally urge said flow valve element toward said valve seat;

third biasing means for normally biasing said flow valve element to raise off said valve seat.

35. The filling valve of claim 34, further comprising a piston in said housing and axially shiftable through said housing;

said third biasing means joining said piston with said flow valve element, such that with said piston moving down toward said valve seat, said flow valve element is moved to said valve seat.

36. The filling valve of claim 34, further comprising a filling bell located beneath said filling orifice and shaped for positioning a neck of a container to be filled beneath said filling orifice;

said gas flow tube extending at least into said filling bell such that said gas flow tube can extend into a container whose neck is at said filling bell.

37. The filling valve of claim 34, wherein said flow valve element is generally bell shaped, being relatively narrower near the top and relatively wider near the bottom; said flow valve element having a width at said bottom thereof that is slightly larger than said filling orifice through said housing;

a sealing element at said bottom of said flow valve element and opposed to said valve seat.

38. The filling valve of claim 37, further comprising a piston in said housing and axially shiftable through said housing;

said third biasing means joining said piston with said flow valve element, such that with said piston moving down toward said valve seat, said valve element is moved to said valve seat.

39. The filling valve of claim 1, further comprising a relatively stationary housing which is stationary with respect to shifting of said flow valve element onto and off said valve seat and with respect to movement of said closure element support under the influence of said second biasing means; said second biasing means being connected between said closure element support and said relatively stationary housing.

40. The filling valve of claim 39, further comprising a third biasing means for normally biasing said flow valve element to raise off said valve seat; said third biasing means operating independently of said second biasing means.

41. The filling valve of claim 40, wherein said third biasing means is connected between said flow valve element and said housing.

42. The filling valve of claim 1, wherein said support comprises a sleeve around said gas flow tube; said support having a hollow therein and said support sleeve and its said hollow extending above said first gas flow opening;

said closure element being supported inside said support sleeve hollow and above said first gas flow opening;

said sleeve has a gas flow hole therethrough for communicating from the outside of said sleeve into said sleeve at a location further from said first gas flow opening than said closure element;

blocking means for selectively blocking said gas flow hole upon movement of said flow valve element to said valve seat while said closure element is in said first position thereof.

43. The filling valve of claim 42, further comprising a guide sleeve around said closure element support and being movable together with said flow valve element; said blocking means being carried on said guide sleeve for being moved therewith between positions at which said blocking means blocks said gas flow hole and unblocks said gas flow hole.

44. The filling valve of claim 43, wherein said guide sleeve has a passage therethrough to the exterior thereof, and said blocking means blocking said gas flow hole comprising said blocking means blocking communication between said gas flow hole and said guide sleeve passage.

45. The filling valve of claim 44, wherein said blocking means comprises a pair of spaced apart sealing elements, which block said gas flow hole by straddling said gas flow hole and which unblock said gas flow hole by both moving beyond said gas flow hole in one direction, for establishing communication between said gas flow hole and said guide sleeve passage.

46. A cover for use with a filling valve which filling valve is used for filling a container with liquid from a pressurized bowl, wherein the filling valve with which said cover is used includes a gas flow tube having a first gas flow opening over which said cover is positioned and having a second gas flow opening, and wherein the filling valve also includes a liquid flow valve element for throttling liquid flow through a filling orifice in the pressurized bowl;

said cover comprising:

a closure element that is shaped for blocking the first gas flow opening in the gas flow tube; said closure element being movable between a first position away from the first gas flow opening and a second position at and blocking the first gas flow opening;

a support for said closure element; first biasing means connecting said closure element support and said closure element for normally biasing said closure element against moving to said second position; said first biasing means has the characteristic that upon a predetermined gas pressure differential developing between the interior of said bowl at said first gas flow opening, on the one hand, and at said second gas flow opening, on the other hand, said closure element is urged to its said second position by the gas flow through said first gas flow opening to said second gas flow opening, and the bias of said first biasing means is overcome;

second biasing means for connecting said closure element support and the gas flow tube with which said cover is associated for biasing said support in a direction to move said closure element away from said second position thereof.

47. The cover of claim 46, wherein said support comprises a sleeve that may be positioned around the gas flow tube; said support sleeve having a hollow therein in which gas flow tube would be received;

said closure element being supported by said support sleeve and in said hollow thereof at a location that would be above the first gas flow opening of the gas flow tube.

48. The cover of either of claims 46 or 47, further comprising a guide for said closure element support; said guide being connectable to the gas flow tube so as to be shiftable therewith;

said second biasing means being connected between said guide and said support.

49. The cover of claim 48, wherein said guide also comprises a sleeve around and supporting said support sleeve within said guide sleeve; said support sleeve being axially shiftable with respect to said guide sleeve; said guide sleeve being engageable with means connected on the gas flow tube.

50. The cover of claim 49, further comprising an additional sleeve outside said guide sleeve; said additional sleeve supporting and orienting said guide sleeve for axially directed motion with respect to said additional sleeve.

51. The cover of claim 47, wherein said first biasing means comprises a ring supported in said support sleeve hollow and said closure element is shaped to be supported at the side of said ring away from the first gas flow opening;

said closure element and said ring being shaped and being of materials such that upon a predetermined gas pressure differential developing between the first and second gas flow openings, said closure element may be pulled, by the gas moved by the pressure differential, past said ring to its said second position.

52. The cover of claim 47, wherein said first biasing means comprises a spring supported by said sleeve and continuously supporting said closure element;

said spring having the characteristic that with said closure element in its said first position and upon a predetermined gas pressure differential developing between said first and said second gas flow openings, said closure element may be pulled, by the gas moved by the pressure differential, to charge said first biasing means spring as said closure element moves to its said second position.

53. The cover of claim 52, wherein said spring is attached to said closure element.

54. The cover of claim 47, wherein said first biasing means comprises a tension spring and said closure element is normally supported by said tension spring above the first gas flow opening; said tension spring being supported by said sleeve still further from the first gas flow opening than said closure element;

said spring having the characteristic that with said closure element in its said first position and upon a predetermined gas pressure differential developing between the first and the second gas flow openings, said closure element may be pulled, by the gas moved by the pressure differential, to charge said first biasing means spring as said closure element moves to its said second position.

55. The cover of claim 54, wherein said sleeve has a gas flow hole therethrough for communicating from the outside of said sleeve into said sleeve at a location further from the first gas flow opening than said closure element.

56. The cover of claim 54, wherein said sleeve has a flow hole therethrough for communicating from the outside of said sleeve into said sleeve between said closure element and the first gas flow opening when said closure element is off said second position thereof.

57. The cover of claim 56, wherein said sleeve has a second gas flow hole therethrough for communicating from the outside of said sleeve into said sleeve at a location further from the first gas flow opening than said closure element.

58. The cover of claim 54, wherein said spring is attached to said closure element.

* * * * *